US008445391B2

(12) United States Patent
Nakayama et al.

(10) Patent No.: US 8,445,391 B2
(45) Date of Patent: May 21, 2013

(54) LEATHER-LIKE SHEET AND METHOD OF MANUFACTURING THE SAME

(75) Inventors: Kimio Nakayama, Okayama (JP); Tsuyoshi Yamasaki, Okayama (JP); Nobuo Takaoka, Okayama (JP); Jiro Tanaka, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 768 days.

(21) Appl. No.: 12/088,565

(22) PCT Filed: Sep. 28, 2006

(86) PCT No.: PCT/JP2006/319332
§ 371 (c)(1),
(2), (4) Date: Jun. 17, 2009

(87) PCT Pub. No.: WO2007/040144
PCT Pub. Date: Apr. 12, 2007

(65) Prior Publication Data

US 2009/0274862 A1 Nov. 5, 2009

(30) Foreign Application Priority Data

Sep. 30, 2005 (JP) ..... 2005-287994
Sep. 30, 2005 (JP) ..... 2005-287995
Sep. 30, 2005 (JP) ..... 2005-287996

(51) Int. Cl.
*D06C 11/00* (2006.01)
*B32B 27/04* (2006.01)
*D04H 3/08* (2006.01)

(52) U.S. Cl.
USPC ..... 442/105; 442/340; 442/361; 428/91; 428/904; 28/103

(58) Field of Classification Search
USPC ..... 428/91, 904; 442/105, 340, 361; 28/103
See application file for complete search history.

(56) References Cited

U.S. PATENT DOCUMENTS 6,479,153 B1 11/2002 Kato et al.
2001/0038901 A1 11/2001 Morishima et al.

FOREIGN PATENT DOCUMENTS

EP 0 651 090 A1 5/1995
JP 64-020368 1/1989
JP 06-316877 11/1994
JP 09-132876 5/1997
JP 2000-273769 10/2000
JP 2000-355885 12/2000
JP 2001-081676 3/2001
JP 2001-081678 3/2001
JP 2001-192980 7/2001
JP 2002-180380 A 6/2002
JP 2003-64585 A 3/2003
JP 2003-328276 11/2003
JP 2004-084142 3/2004

OTHER PUBLICATIONS

U.S. Appl. No. 12/593,399, filed Sep. 28, 2009, Tanaka, et al.
Luenenschloss, et al., "Vliesstoffe" 19820101, XP002547833, Jan. 1, 1982, pp. 122-169.
U.S. Appl. No. 13/638,759, filed Oct. 1, 2012, Nakayama, et al.
U.S. Appl. No. 12/088,565, filed Jun. 17, 2009, Nakayama, et al.
English translation of Japanese Office Action issued on Jun. 21, 2011 in corresponding Japanese Application No. 2007-538732.

*Primary Examiner* — Jenna Johnson
(74) *Attorney, Agent, or Firm* — Oblon, Spivak, McClelland, Maier & Neustadt, L.L.P.

(57) ABSTRACT

A leather-like sheet composed of a microfine-fiber entangled body made of bundles of microfine fibers and an elastic polymer impregnated therein. The bundles of microfine fibers are composed of microfine monofibers having an average cross-sectional area of 0.1 to 30 $\mu m^2$ and have an average cross-sectional area of 40 to 400 $\mu m^2$. The bundles of microfine fibers exist in a density of 600 to 4000/$mm^2$ on a cross section taken along the thickness direction of the microfine-fiber entangled body. The elastic polymer contains 30 to 100% by mass of a polymer of ethylenically unsaturated monomer. The polymer of ethylenically unsaturated monomer is composed of a soft component having a glass transition temperature (Tg) of less than −5° C., a crosslinkable component, and optionally a hard component having a glass transition temperature (Tg) of higher than 50° C. and another component. The polymer of ethylenically unsaturated monomer is bonded to the microfine fibers in the bundles of microfine fibers. The leather-like sheet has a flexibility and hand such as dense feeling each resembling natural leathers and a high quality appearance. The leather-like sheet is highly stable in quality such as fastness and surface abrasion resistance and excellent in practical performance.

17 Claims, No Drawings

LEATHER-LIKE SHEET AND METHOD OF MANUFACTURING THE SAME

TECHNICAL FIELD

The present invention relates to a leather-like sheet which has an excellent flexibility and hand such as dense feeling each resembling natural leathers and an appearance with high quality, and which is excellent in the fastness and quality stability such as surface abrasion resistance and also in the practical performance. The present invention further relates to the production of a grain-finished artificial leather, suede-finished artificial leather, or semi grain-finished artificial leather by an environmentally-friend method.

BACKGROUND ART

A leather-like sheet such as artificial leather has come to be widely used in clothes, general materials, sport goods, etc. because its superiority to natural leathers such as its light weight and easiness of handling has been accepted by consumers. Known general artificial leathers have been produced by a method roughly including a step of making microfine fiber-forming composite fibers made of two kinds of polymers having different solubilities in solvent into staples; a step of making the staples into a web by using a card, cross-lapper, random webber, etc.; a step of entangling the fibers by needle punching, etc. to obtain a nonwoven fabric; a step of impregnating an elastic polymer such as polyurethane in the form of solution in a solvent; and a step of converting the composite fibers to microfine fibers by removing one component of the composite fibers.

However, the staples are relatively easily and unavoidably pulled out or fallen out of the nonwoven fabric body because of their short fiber length. With such an unfavorable tendency, the important surface properties such as a fastness to surface abrasion of napped artificial leathers and an adhesion strength resistant to peeling of grain-finished artificial leathers become insufficient. In addition, an excessive elongation of products and a pull-out of surface fibers occur during the production process, to impair the dense feeling and surface appearance and deteriorate the quality stability.

To solve the above problem, generally employed are, for example, a method of increasing the degree of entanglement of the nonwoven fabric body and a method of increasing the amount of the elastic polymer to be impregnated so as to bind the fibers and strongly constrain the fibers. However, if the degree of entanglement and the amount of the elastic polymer are increased to a level sufficient for solving the above problem, the hand of artificial leather is remarkably impaired. Thus, an artificial leather which satisfies the appearance, hand and surface properties at the same time has not been hitherto realized.

Unlike the production of a short-fiber nonwoven fabric, the production of a long-fiber nonwoven fabric is simple because a series of large apparatuses such as a raw fiber feeder, an apparatus for opening fibers and a carding machine is not needed. In addition, the long-fiber nonwoven fabric is superior to the short-fiber nonwoven fabric in the strength and shape stability. Therefore, the long-fiber nonwoven fabric has been used as the substrate for leather-like sheets. However, only a grain-finished artificial leather having a substrate which is made of long fibers having a normal fineness of 0.5 dtex or more has been on the market. Artificial leathers made of microfine long fibers have not yet been put on the market. This is because that an entangled web having a stable mass per unit is difficult to produce from long fibers, the uneven fineness and strain of composite long fibers likely cause a product-to-product variation, and the dense feeling is poor and the hand likely becomes cloth-like because long fibers are poor in bulkiness as compared with crimped short fibers.

Patent Document 1 proposes a method of preventing the unevenness and improving the bulkiness, in which the nonwoven fabric is densified by partly cutting long fibers to partly relive the strain. However, the proposed method reduces the advantages of long fibers such as improvement in the tenacity and interlaminar peeling strength, and may fail to effectively use the surface abrasion, shape stability, etc. which are characteristic of long fibers. Patent Document 2 proposes to prevent the change of shape of a composite sheet by reinforcing an entangled body of long fibers with a knitted or woven fabric, etc. However, the defect such as wrinkling due to the strain relaxation of fibers cannot be prevented by the mere reinforcement with a fabric. Thus, the appearance and hand and the surface properties are not satisfied at the same time also in artificial leather using a long-fiber nonwoven fabric.

In view of the mechanical strength, fastness to dyeing, hand and appearance of napped surface of leather-like sheet, the elastic polymer is provided into a nonwoven fabric for constituting a fibrous substrate generally by impregnating a solution of a polyurethane elastomer in an organic solvent such as dimethylformamide and then coagulating the solution. However, since a known nonwoven fabric is not sufficient in its shape retention and easily causes pull-out of fibers, a large amount of elastic polymer is needed. Therefore, in a leather-like sheet having napped fibers on its surface, the color unevenness becomes striking because of the difference in the dyeability between a large amount of the impregnated elastic polymer and the fibers, thereby reducing the quality appearance and quality stability. Another problem is that the elastic polymer having exhausted dye thereon falls off during use to remarkably deteriorate the color fastness. In addition, since the rubbery feeling which is characteristic of polyurethane is enhanced, an artificial leather having a natural leather-like dense feeling and flexibility cannot be obtained. In an alternative method, the nonwoven fabric is dyed by a jet dyeing without providing the elastic polymer. However, in the jet dyeing, the nonwoven fabric is repeatedly subject to violent flexing in a high-temperature hot water. Therefore, the nonwoven fabric is largely elongated and torn, and the pull-out of surface fibers is increased, to significantly deteriorate the process passing property (property to be successfully subjected to the treatment intended in each process without problems) and the quality of products being produced. Therefore, this method is hardly applied to industrial production.

To avoid the use of organic solvent in view of protecting the environment and assuring the safety, various methods of producing a leather-like sheet have been proposed, in which an aqueous dispersion of urethane elastomer is used in place of an organic solution of urethane elastomer (Patent Documents 3 and 4). However, as compared with the organic solvent-soluble urethane elastomer, the water-dispersible polyurethane provides a hard hand and is inferior in the napping property of surface fibers and the mechanical strength. In addition, a leather-like sheet impregnated with the water-dispersible polyurethane is extremely poor in the wet color fastness because of the high water absorption and easiness of exhausting dyes of the water-dispersible polyurethane, thereby making its use difficult. In some cases, in addition to the urethane elastomer, an acrylic elastomer may be used to control the hand of knitted or woven fabrics. However, in view of mechanical strength, color fastness, hand and appearance of surface napped fibers, the elastic polymer to be provided into the leather-like sheet has been practically limited to urethane elastomer.

Patent Document 1: JP 2000-273769A
Patent Document 2: JP 64-20368A
Patent Document 3: JP 6-316877A
Patent Document 4: JP 9-132876A

DISCLOSURE OF THE INVENTION

An object of the present invention is to solve the above problems in the prior art, and provide a leather-like sheet which has an excellent flexibility and hand such as dense feeling each resembling natural leathers and an appearance with high quality, and which is excellent in the fastness and quality stability such as surface abrasion resistance and also in the practical performance. Another object of the present invention is to produce a grain-finished artificial leather, suede-finished artificial leather, and semi grain-finished artificial leather by an environmentally-friend method.

As a result of extensive research in view of achieving the above objects, the inventors have reached the present invention. Namely, the present invention provides a leather-like sheet which comprises a microfine-fiber entangled body made of bundles of microfine fibers and an elastic polymer impregnated into the microfine-fiber entangled body, which meets the following requirements:

(1) the bundles of microfine fibers are made of microfine monofibers having an average cross-sectional area of 0.1 to 30 $\mu m^2$ and an average cross-sectional area of the bundles of microfine fibers is 40 to 400 $\mu m^2$;
(2) the bundles of microfine fibers exist in a density of 600 to 4000/$mm^2$ on a cross section taken along a thickness direction of the microfine-fiber entangled body;
(3) the elastic polymer comprises 30 to 100% by mass of a polymer of ethylenically unsaturated monomer, and the polymer of ethylenically unsaturated monomer comprises 80 to 98% by mass of a soft component having a glass transition temperature (Tg) of lower than −5° C., 1 to 20% by mass of a crosslinkable component, 0 to 19% by mass of a hard component having a glass transition temperature (Tg) of higher than 50° C. and 0 to 19% by mass of another component; and
(4) the polymer of ethylenically unsaturated monomer is bonded to microfine fibers in the bundles of microfine fibers.

The present invention further provides a method of producing a leather-like sheet which comprises:

(1) a step of producing a fiber web made of microfine fiber-forming fibers;
(2) a step of entangling the fiber web to obtain an entangled nonwoven fabric;
(3) a step of subjecting the entangled nonwoven fabric to areal shrinking by 35% or more;
(4) a step of converting the microfine fiber-forming fibers in the entangled nonwoven fabric after shrinking to microfine fibers, thereby producing a microfine-fiber entangled body comprising bundles of microfine fibers having an average cross-sectional area of 40 to 400 $\mu m^2$, the bundles of microfine fibers comprising microfine monofibers having an average cross-sectional area of 0.1 to 30 $\mu m^2$, and the bundles of microfine fibers existing in a density of 600 to 4000/$mm^2$ on a cross section taken along a thickness direction of the microfine-fiber entangled body; and
(5) a step of impregnating an elastic polymer into the microfine-fiber entangled body, the elastic polymer comprising 30 to 100% by mass of a polymer of ethylenically unsaturated monomer, and the polymer of ethylenically unsaturated monomer comprising 80 to 98% by mass of a soft component having a glass transition temperature (Tg) of lower than −5° C., 1 to 20% by mass of a crosslinkable component, 0 to 19% by mass of a hard component having a glass transition temperature (Tg) of higher than 50° C. and 0 to 19% by mass of another component.

BEST MODE FOR CARRYING OUT THE INVENTION

The microfine-fiber entangled body (also simply referred to as "fiber entangled body") which constitutes the main part of the leather-like sheet comprises bundles of microfine fibers. Each bundle of microfine fibers has a cross-sectional area of 40 to 400 $\mu m^2$ and preferably contains 5 to 1000 microfine monofibers having an average cross-sectional area of 0.1 to 30 $\mu m^2$. The fibers for producing the microfine-fiber entangled body are not particularly limited as long as the fibers are convertible to the bundles of microfine fibers, and may be selected from microfine fiber-forming fibers having a sea-island cross section or a multi-layered cross section which can be produced by a mix spinning method or composite spinning method. In view of easiness of obtaining the flexibility and dense feeling resembling natural leather and good productivity, the fineness of the microfine fiber-forming fibers is preferably 0.5 to 3 dtex and more preferably 0.8 to 2.5 dtex.

Any polymers which are convertible to microfine fibers by extraction treatment without being extracted may be suitable as the polymer for constituting the microfine fibers and are selected according to the final use and required properties. Examples thereof include aromatic polyester and its copolymer such as polyethylene terephthalate, isophthalic acid-modified polyethylene terephthalate, sulfoisophthalic acid-modified polyethylene terephthalate, polybutylene terephthalate, and polyhexamethylene terephthalate; aliphatic polyester and its copolymer such as polylactic acid, polyethylene succinate, polybutylene succinate, polybutylene succinate adipate, and polyhydroxybutyrate-polyhydroxyvalerate copolymers; polyamide and its copolymer such as nylon 6, nylon 66, nylon 10, nylon 11, nylon 12, and nylon 6-12; polyolefin and its copolymer such as polypropylene, polyethylene, polybutene, polymethylpentene, and chlorine-containing polyolefin; modified polyvinyl alcohol containing 25 to 70 mol % ethylene units; and elastomer such as polyurethane elastomer, nylon elastomer, and polyester elastomer. These polymers may be used alone or in combination of two or more. For example, when the microfine fiber-forming fibers are multi-layered fibers, two or more kinds of polymers which can be separated or split are combinedly used. Of the above, polyethylene terephthalate (PET), isophthalic acid-modified polyethylene terephthalate, polylactic acid, nylon 6, nylon 12, nylon 6-12, copolymers of the preceding polyamide, and polypropylene are suitable because of their good productivity such as spinnability and good mechanical properties of resultant leather-like sheet, with PET and modified resin such as isophthalic acid-modified PET being particularly preferred because the entangled body of long fibers thereof exhibits a good shrinking property in the hot water treatment.

The above polymers may be added with an additive as long as the object and effect of the present invention are not adversely affected. Examples of such additive include catalyst, discoloration inhibitor, heat resistance improver, fire retardant, lubricant, antifouling agent, fluorescent brightener, delustering agent, colorant, gloss improver, antistatic agent, perfume, deodorant, anti-fungus agent, miticide, and inorganic fine powder.

The bundles of microfine fibers are formed by removing a removable polymer from the microfine fiber-forming fibers such as sea-island fibers and multi-layered fibers, for example, by extraction. Any known polymers are usable as the removable polymer as long as they are capable of forming sea-island composite fibers or multi-layered fibers and easily removed. A water-soluble, thermoplastic resin which can be removed by water or an aqueous solution is preferred in view of reducing the environmental load. The water-soluble, thermoplastic resin is a polymer which can be removed by dissolution or decomposition under heating or pressure by using water, an aqueous alkali solution or an aqueous acid solution. Examples thereof include modified polyesters copolymerized with polyethylene glycol and/or a compound having an alkali metal sulfonate, polyvinyl alcohol, polyvinyl alcohol-based copolymers, and polyethylene oxide. Particularly preferred is a water-soluble, thermoplastic polyvinyl alcohol resin (PVA resin) such as polyvinyl alcohol-based copolymer which is extractable with water or an aqueous solution.

PVA resin is preferably used because:

(1) the microfine fiber-forming fibers shrink during the removing treatment by extraction with water to crimp the formed microfine fibers, thereby making the resultant nonwoven fabric bulky and densified. Such a nonwoven fabric is colored brightly and gives a suede-finished leather-like sheet with a very soft, natural leather-like good hand;

(2) since the polymer for forming the microfine fibers and elastic polymer are substantially free from being decomposed during the removing treatment by extraction, the properties of the microfine fibers and elastic polymer are hardly deteriorated; and (3) the environmental load is small.

Since the spinnability of PVA resin are poor at excessively high temperatures, it is preferred to suitably select the melting point of the polymer for forming the microfine fibers. The melting point of the polymer for forming the microfine fibers is preferably the melting point of PVA resin +60° C. or lower, and the melting point (Tm) of PVA resin is preferably 160 to 250° C. in view of spinnability.

The viscosity average polymerization degree (hereinafter merely referred to as "polymerization degree") of PVA resin is preferably 200 to 500, more preferably 230 to 470, and still more preferably 250 to 450. If being 200 or more, a melt viscosity sufficient for stably making PVA resin into a composite with other polymer can be obtained. If being 500 or less, the melt viscosity is not excessively high and the extrusion from a spinning nozzle is easy. By using PVA resin having a polymerization degree of 500 or less, i.e., a low-polymerization degree PVA resin, the dissolution during a hot water treatment becomes favorably quick. The polymerization degree (P) is measured according to JIS-K6726, in which PVA resin is re-saponified and purified, and then, an intrinsic viscosity [η] is measured in water of 30° C. The polymerization degree (P) is calculated from the following equation:

$$P=([\eta]10^3/8.29)^{(1/0.62)}.$$

The saponification degree of PVA resin is preferably 90 to 99.99 mol %, more preferably 93 to 99.98 mol %, still more preferably 94 to 99.97 mol %, and particularly preferably 96 to 99.96 mol %. If being 90 mol % or more, the heat stability of PVA resin is good and a defect melt spinning due to thermal decomposition and gelation can be avoided. In addition, the biodegradability is good. Also, since the water solubility of PVA resin is not lowered according to the kind of comonomer to be mentioned below, the microfine fiber-forming long fibers are stably produced. PVA having a saponification degree exceeding 99.99 mol % is difficult to produce stably.

PVA resin is biodegradable and decomposed to water and carbon dioxide by an activated sludge treatment or by being laid underground. It is preferred to treat a PVA-containing waste water from the removing treatment of PVA resin by dissolution with activated sludge. PVA resin is completely decomposed within a period of from two days to one month when a PVA-containing waste water is continuously treated with activated sludge. Since the combustion heat is low to impose little load of heat to an incinerator, PVA resin may be incinerated after drying a PVA-containing waste water.

The melting point of PVA resin (Tm) is preferably 160 to 250° C., more preferably 170 to 227° C., still more preferably 175 to 224° C., and particularly preferably 180 to 220° C. If being 160° C. or higher, the lowering in the strength of fibers containing PVA resin due to the reduced crystallizability is prevented. In addition, the heat stability of PVA resin is good and the fiber formation is good. If being 250° C. or lower, the microfine fiber-forming long fibers are stably produced because the melt spinning can be performed at temperatures sufficiently lower than the decomposition temperature of PVA.

PVA resin is produced by saponifying a resin mainly composed of vinyl ester units. Examples of the vinyl monomer for forming the vinyl ester units include vinyl formate, vinyl acetate, vinyl propionate, vinyl valerate, vinyl caprate, vinyl laurate, vinyl stearate, vinyl benzoate, vinyl pivalate, and vinyl versatate, with vinyl acetate being preferred because of easiness of production of PVA resin.

PVA resin may be homo PVA or modified PVA introduced with a comonomer unit, with modified PVA being preferred in view of melt-spinnability, water-solubility and fiber properties. In view of copolymerizability, melt-spinnability and water solubility of fibers, the comonomer is preferably α-olefin having 4 or less carbon atoms such as ethylene, propylene, 1-butene, and isobutene; and vinyl ether such as methyl vinyl ether, ethyl vinyl ether, n-propyl vinyl ether, isopropyl vinyl ether, and n-butyl vinyl ether. Since the ethylene comonomer unit enhances the fiber properties, ethylene-modified PVA is particularly preferred. The content of the ethylene comonomer units in modified-PVA resin is preferably 4 to 15 mol %, and more preferably 6 to 13 mol %.

PVA resin may be produced by a known method such as bulk polymerization, solution polymerization, suspension polymerization, and emulsion polymerization. Generally, a bulk polymerization or solution polymerization which is performed in the absence of solvent or in the presence of a solvent such as alcohol is employed. Examples of the solution for the solution polymerization include lower alcohols such as methyl alcohol, ethyl alcohol and propyl alcohol. The copolymerization is performed in the presence of a known initiator, for example, an azo initiator or peroxide initiator such as a,a'-azobisisobutyronitrile, 2,2'-azobis(2,4-dimethylvarelonitrile), benzoyl peroxide, and n-propyl peroxycarbonate. The polymerization temperature is not critical and a range of from 0 to 150° C. is recommended.

The leather-like sheet of the invention is produced by producing a fiber web from microfine fiber-forming fibers; entangling the fiber web to obtain an entangled nonwoven fabric; converting the microfine fiber-forming fibers to microfine fibers, thereby obtaining a microfine-fiber entangled body; and then impregnating an elastic polymer into the microfine-fiber entangled body.

The fiber web is produced by any of known methods and preferably, but not limited to, a long fiber web in view of a good shape stability and the resistance to fiber pull-out, which is produced by a spun bond method directly combined with the melt spinning.

In the present invention, the term "long fiber" means a fiber longer than a short fiber generally having a length of about 10 to 50 mm and a fiber not intentionally cut as so done in the production of short fibers. For example, the length of the long fibers before converted to microfine fibers is preferably 100 mm or longer, and may be several meters, hundreds of meter, or several kilo-meters as long as being technically possible to produce or being not physically broken.

For example, to produce the fiber web by the spun bond method, PVA resin and a water-insoluble, thermoplastic resin (polymer for forming the microfine fibers) are respectively melt-kneaded in different extruders. The flows of molten resins are introduced to a spinning head through a combining nozzle and extruded from a nozzle. The extruded composite long fibers are cooled by a cooling apparatus, drawn to an intended fineness by air jet with a speed corresponding to a take-up speed of 1000 to 6000 m/min using a sucking apparatus, and then collected on a moving surface. After partially pressing the collected long fibers, if needed, the long fiber web made of microfine fiber-forming fibers is obtained. In view of easiness of handling, the mass per unit are of the fiber web is preferably from 20 to 500 g/m$^2$.

The mass ratio of the water-soluble, thermoplastic resin and the water-insoluble, thermoplastic resin in the microfine fiber-forming fibers is preferably from 5/95 to 50/50. Within the above range, the microfine fiber-forming fibers have a cross-sectionally good shape, and since the microfine fibers are completely covered with the water-soluble, thermoplastic resin, the process passing properties are good. In addition, the resultant microfine-fiber entangled body has a good shape stability and the surface abrasion loss is reduced. The mass ratio is particularly preferably from 10/90 to 40/60.

After oiling the fiber web thus produced with an oil agent of silicone, mineral oil or other types such as anti-needle break oil agent, antistatic oil agent and entangling oil agent, the fiber web is entangled by a known method such as needle punching to obtain an entangled nonwoven fabric. By the needle punching, the fibers are three-dimensionally entangled to increase the shape retention, and an entangled nonwoven fabric with little fiber pull-out is obtained. If needed, superposed two or more fiber webs obtained by using a crosslapper, etc. may be oiled and then entangled. Using such superposed fiber webs, the unevenness of mass per unit area is preferably reduced. The number of the superposed fiber webs and the mass per unit area of the superposed fiber webs may be properly determined according to the intended thickness of the leather-like sheet. The overall mass per unit area of the superposed webs is preferably from 100 to 1000 g/m$^2$ because of easiness of handling.

The kind of the oil agent, its amount to be used, and the needling conditions such as shape of needle, punching depth and number of punch are preferably determined so as to enhance the interlaminar peeling strength of the fiber-entangled sheet. Although the needling becomes more efficient with increasing number of barbs, the number of barbs is selected from a range not causing needle break, for example, from 1 to 9. The punching depth is determined so as to allow the barbs to penetrate through the superposed webs and so as to prevent clear needle-punching marks on the surface of web. The number of needle punching varies according to the shape of needles, kind of oil agent and amount thereof, and preferably 500 to 5000 punch/cm$^2$. The entanglement is preferably carried out such that the ratio between the mass per unit area after entanglement and the mass per unit area before entanglement is 1.2 or more. The ratio is more preferably 1.5 or more, because the shape retention is enhanced, the fiber pull-out is reduced and a dense feeling resembling natural leathers is obtained. The upper limit of the ratio is not critical, and preferably 4 or less in view of preventing the increase of production costs due to the deterioration of process passing properties and the lowering of treating speed.

The entanglement is preferably carried out so that the interlaminar peeling strength of the resultant entangled nonwoven fabric is 2 kg/2.5 cm or more. The interlaminar peeling strength is more preferably 4 kg/2.5 cm or more because a microfine-fiber entangled body with little fiber pull-out having a good apparent density and good shape retention is obtained in the next production step. The interlaminar peeling strength of the entangled nonwoven fabric is a measure for the degree of three-dimensional entanglement. If less than 2 kg/2.5 cm, the entanglement is insufficient to result in the failure of obtaining a microfine-fiber entangled body having a surface abrasion loss of 100 mg or less (by Martindale method, 50,000 abrasion cycles) and an interlaminar peeling strength of 8 kg/2.5 cm or more. If the surface abrasion loss is large and the interlaminar peeling strength is small, the slippage between the fibers are likely to occur, thereby resulting in a insufficient shape retention, increased fiber pull-out and poor dense feeling. The upper limit of the interlaminar peeling strength of entangled nonwoven fabric is not critical and preferably 30 kg/2.5 cm or less in view of the balance between the needle puching efficiency and hand, particularly, in view of preventing the drawback such as needle break.

To enhance the shape stability of the microfine-fiber entangled body to be obtained in the next production step, the entanglement may be carried out by needle punching and/or water jetting after superposing a knitted or woven fabric (knitted fabric or woven fabric) on the fiber web, to obtain an entangled nonwoven fabric united with the knitted or woven fabric having a laminate structure such as knitted or woven fabric/entangled nonwoven fabric, and entangled nonwoven fabric/knitted or woven fabric/entangled nonwoven fabric. The knitted or woven fabric is preferably made from fibers having a single fiber fineness of 3.5 dtex or less, particularly preferably made from filaments capable of forming bundles of microfine fibers which are composed of single fibers having an average cross-sectional area of 0.1 to 30 μm$^2$ and have an average cross-sectional area of 40 to 400 μm$^2$, for example, multifilaments having a twist number of 10 to 2000 turn/n, because the hand and appearance of leather-like sheet are improved.

Examples of the polymer for forming the fibers constituting the knitted or woven fabric include, but not limited to, fiber-forming polymers, for example, polyester such as polyethylene terephthalate (PET), polytrimethylene terephthalate, polybutylene terephthalate (PBT) and polyester elastomer; polyamide such as nylon 6, nylon 66, aromatic polyamide and polyamide elastomer; urethane polymer; olefin polymer; and acrylonitrile polymer, with PET, PBT, nylon 6 and nylon 66 being particularly preferred because of their hand and practical performance.

When a knitted or woven fabric made of microfine fiber-forming fibers is used, the removable component is preferably composed of one or more of polystyrene, its copolymers, polyethylene, PVA, copolyester, and copolyamide. Taking the prevention of environmental pollution and the shrinking properties during the removal by resolution into consideration, a hot-melting, hot water-soluble PVA is preferably used. Since a large shrinking occurs during the removal of such PVA by dissolution, the leather-like sheet is highly densified and the aesthetic appearance and hand of leather-like sheet closely resemble the those of natural leathers.

The entangled nonvwoven fabric obtained by entanglement is then highly densified by shrinking. In the present invention, microfine fibers in the microfine-fiber entangled body are entangled to a considerable degree by an extremely large shrinking, thereby reducing the fiber pull-out and obtaining a leather-like sheet having a good dense feeling and suede appearance. The shrinking treatment is performed preferably until the areal shrinkage represented by the following formula:

[(area before shrinking treatment−area after shrinking treatment)/area before shrinking treatment]×100 reaches 35% or more and the mass per unit area after shrinking treatment reaches 1.2 times the mass per unit area before shrinking treatment. In view of shrinking limit and hand, the upper limit of the areal shrinkage is preferably 80% or less and the upper limit of the mass per unit area is preferably 4 times or less. A large shrinking can be obtained by a known method, for example, by using a thermoplastic copolymer as the removal component of the microfine fiber-forming fibers or by suitably selecting the spinning conditions or stretching conditions. Particularly, PVA resin is preferably used as the removal component of the microfine fiber-forming fibers or a long fiber web is preferably used, because a large shrinking is easily obtained.

The shrinking treatment is performed by a known method. When the microfine fiber-forming fibers contain PVA resin, the shrinking treatment and the conversion to microfine fibers by dissolving or extracting PVA resin for removal can be simultaneously conducted by a hot-water treatment. In this case, the hot-water treatment is performed preferably in two stages of the shrinking treatment and the extraction treatment, because the efficiency of shrinking and removal is good. For example, in the first stage, the entangled nonwoven fabric is immersed in a hot water preferably at 65 to 90° C. for 5 to 300 s. In the second stage, the entangled nonwoven fabric is further treated in a hot water preferably at 85 to 100° C. for 100 to 600 s. Alternatively, the removal by dissolution or extraction may be conducted after the shrinking treatment by steam heating. The steam heating is conducted in a steam atmosphere preferably at a relative humidity of 75% or more, more preferably at a relative humidity of 90% or more for 60 to 600 s. If the relative humidity is 75% or more, an areal shrinkage of 35% or more is easily obtained, because immediate dry of water attaching to the fibers is prevented. The shrinking temperature (ambient temperature) is preferably 60 to 130° C., because the temperature control is easy and the entangled nonwoven fabric shrinks largely. By the method described above, the entangled nonwoven fabric shrinks in an areal shrinkage of 35% or more, and the microfine fiber-forming fibers are converted to microfine fibers having an average single fiber fineness of 0.0001 to 0.5 dtex after or simultaneously with the shrinking.

In the present invention, by the above tree-dimensional entanglement, shrinking treatment and conversion to microfine fibers, the microfine-fiber entangled body which is composed of bundles of microfine fibers having an average cross-sectional area of 40 to 400 $\mu m^2$ is obtained. Each of the bundles contain preferably 5 to 1000 microfine monofibers having an average cross-sectional area of 0.1 to 30 $\mu m^2$ and the bundles of microfine fibers exist in a density of 600 to 4000/$mm^2$ on a cross section taken along the thickness direction of the microfine-fiber entangled body.

With such single fibers having a fineness as small as an average cross-sectional area of 0.1 to 30 $\mu m^2$ and bundles of microfine fibers having an average cross-sectional area as small as 40 to 400 $\mu m^2$, a leather-like sheet excellent in flexibility and appearance is obtained. Since the fineness is small, the frictional resistance between fibers increase, this enhancing the shape retention of the microfine-fiber entangled body to reduce the fiber pull-out. The conversion of microfine fiber-forming fibers to fibers having a single fiber fineness of less than 0.1 $\mu m^2$ takes a long period of time and makes the color development of the resultant suede-finished artificial leather insufficient. If the average cross-sectional area of bundles of microfine fibers is less than 40 $\mu m^2$, the fibers to be converted to such bundles of microfine fibers are frequently broken during the entanglement by needle punching. Therefore, a sufficient entanglement is hardly obtained and the effect of the invention cannot be obtained. If the average cross-sectional area of single fiber exceeds 40 $\mu m^2$ or the average cross-sectional area of bundles of microfine fibers exceeds 400 $\mu m^2$, the hand with dense feeling and elegant surface appearance resembling those of natural leathers are not obtained.

If the bundles of microfine fiber exist in a density of less than 600/$mm^2$ on a cross section taken along the thickness direction of the microfine-fiber entangled body, the hand with dense feeling and elegant surface appearance resembling those of natural leathers are not obtained. In addition, the shape retention of the microfine-fiber entangled body is lowered to increase the fiber pull-out. If the density of bundles of microfine fibers exceeds 4000/$mm^2$, the bundles of microfine fibers and the microfine fibers in the bundles of microfine fibers are likely to be united together. Therefore, the average cross-sectional area of microfine fibers substantially exceeds 30 $\mu m^2$ to make the hand hard.

Thus, it is important for the microfine-fiber entangled body of the present invention to simultaneously satisfy the average cross-sectional area of microfine monofibers, the average cross-sectional area of bundles of microfine fibers and the existence density of bundles of microfine fibers, each being described above. The average cross-sectional area of microfine monofibers, the average cross-sectional area of bundles of microfine fibers and the existence density of bundles of microfine fibers may be determined by observing the cross section or surface of leather-like sheet under a scanning electron microscope.

The microfine-fiber entangled body satisfying the above features surprisingly shows a good shape retention, an extremely reduced fiber pull-out and good process passing properties during or immediately after the extraction for conversion to microfine fibers even when the elastic polymer is not provided. In addition, the microfine-fiber entangled body with no elastic polymer provided can be subject to a hot water treatment for flexibilization and a dyeing treatment, although these treatments are hitherto difficult.

The microfine-fiber entangled body and dyed microfine-fiber entangled body preferably have a Martindale surface abrasion loss (5,000 abrasion cycles) of 100 mg or less, an interlaminar peeling strength of 8 to 30 kg/2.5 cm, and a space filing, i.e., [apparent specific gravity (g/$cm^3$)]/[density of thermoplastic resin constituting microfine fibers density (g/$cm^3$)], of 0.25 to 0.60. If having these properties, the process passing properties in the dyeing process such as jet dyeing are good. According to the present invention, the microfine-fiber entangled body has a Martindale surface abrasion loss of 100 mg or less, an interlaminar peeling strength of 8 to 30 kg/2.5 cm, and a space filling of 0.25 to 0.60 even after dyeing.

If the Martindale surface abrasion loss exceeds 100 mg, the interlaminar peeling strength is less than 8 kg/2.5 cm or the space filling is less than 0.25, the surface becomes rough and coarse or the breaking or wrinkling occurs due to a large elongation in the machine direction when the extraction for converting to microfine fibers, the hot water treatment for flexibilization and the dyeing treatment are conducted without providing the elastic polymer, thereby making the process passing properties poor. In addition, the dense feeling and surface quality of resultant leather-like sheet are poor. In the present invention, it is preferred that the Martindale surface abrasion loss, the interlaminar peeling strength and the space filling are all within the above ranges. The interlaminar peeling strength is a measure for the peeling strength of the microfine-fiber entangled body itself, the degree of three-dimensional entanglement and the lamination strength of knitted or woven fabric/fiber entangled body laminate. If the space filling is 0.60 or more, the hand tends to be hard.

The microfine-fiber entangled body preferably has a breaking strength of 8 kg/cm$^2$ or more per 100 g/m$^2$ and a tear strength of 1.0 kg or more per 100 g/m$^2$, because the shape retention is further improved and the mechanical properties of leather-like sheet are enhanced. The thickness of microfine-fiber entangled body depends on its final use, and preferably 0.2 to 10 mm. The mass per unit area thereof is preferably 50 to 3500 g/m$^2$.

The microfine-fiber entangled body thus obtained has a good shape retention with little fiber pull-out even when the elastic polymer is not impregnated. Therefore, the surface napping treatment, the flexibilizing treatment and the dyeing treatment, which are conventionally made on the leather-like sheet, can be done without impregnating the elastic polymer. The surface napping may be performed by a known method such as a buffing treatment using sand paper or card clothing. The surface-napped microfine-fiber entangled body of the invention has a dense feeling and napping appearance which are not obtained in a known nonwoven fabric having no elastic polymer impregnated, and is suitable as the substrates for producing suede-finished leather-like sheets and grain-finished leather-like sheets having a good surface-napping appearance.

In the present invention, it is preferred to dye the microfine-fiber entangled body before impregnating the elastic polymer, and impregnate the elastic polymer after dyeing. Since the elastic polymer is not dyed, the color unevenness and surface unevenness due to the difference of dye exhaustion between the fibers and elastic polymer are avoided to enhance the quality stability. When applied to suede-finished artificial leathers, the various kinds of fastness such as fastness to wet friction are enhanced. Thus, it is preferred in the present invention that the microfine fibers constituting the leather-like sheet are dyed, but the elastic polymer is not dyed substantially or completely. Also, in the production of the leather-like sheet for suede-finished artificial leathers, nubuck artificial leathers, semi grain-finished artificial leathers and grain-finished artificial leathers, it is preferred to dye the microfine-fiber entangled body before impregnating the elastic polymer and then impregnate the elastic polymer. The dye is suitably selected from known dyes such as disperse dye, acid dye and metal complex dye according to the dyeability of the microfine-fiber entangled body.

The microfine long-fiber entangled body may be added with an additive in a small amount not adversely affecting the effects of the invention. Such additive is selected from penetrant, defoaming agent, lubricant, water repellent, oil repellent, thickener, bulking agent, curing promoter, antioxidant, ultraviolet absorber, fluorescent agent, antimold agent, foaming agent, and water-soluble polymer such as polyvinyl alcohol and carboxymethylcellulose.

In known methods, before converting the microfine fiber-forming fibers to microfine fibers, a water-dispersible elastic polymer such as a hydrogen-bonded polymer is generally impregnated into the entangled nonwoven fabric. The hydrogen-bonded polymer is a polymer crystallized or cohered by hydrogen bonding and examples thereof include polyurethane elastomer, polyamide elastomer and polyvinyl alcohol elastomer. It has been known that the elastic polymer containing the hydrogen-bonded polymer is very adhesive and useful for enhancing the shape retention of entangled nonwoven fabric and reducing the fiber pull-out.

However, if the water-dispersible elastic polymer such as polyurethane elastomer is impregnated into the microfine-fiber entangled body of the invention, the bundles of microfine fibers and microfine fibers are firmly bonded, bound or united together to substantially increase the fineness to over 0.5 dtex, because the bundles of microfine fibers which are made of the microfine fibers having a small average cross-sectional area (0.1 to 30 μm$^2$) and have a small average cross-sectional area (40 to 400 μm$^2$) exist in a density as high as 600 to 4000/mm$^2$ on a cross section taken along the thickness direction of the microfine-fiber entangled body. Therefore, the flexibility of leather-like sheet is reduced and, for example, the suede-finished appearance and the surface touch of the suede-finished artificial leathers are significantly impaired. Although not elucidated, the microfine fibers are bound or united by the elastic polymer more easily as the average fineness is reduced. In addition, as compared with microfine fibers not forming a fiber bundle, the microfine fibers in a fiber bundle are easily bound or united by the elastic polymer. Also, as compared with a solvent-soluble elastic polymer, the water-dispersible elastic polymer easily binds or units the microfine fibers. Particularly, of the elastic polymers, the polyurethane elastomer tends to easily bind or unite the microfine fibers. Therefore, if the polyurethane elastomer, particularly, the water-dispersible polyurethane elastomer is impregnated into the microfine-fiber entangled body of the invention, the microfine fibers are extremely bound or united together.

As a result of extensive research, it has been found that an elastic polymer containing 30 to 100% by mass of a water-dispersible or water-soluble polymer of ethylenically unsaturated monomer, the polymer being composed of 80 to 98% by mass of a soft component having a glass transition temperature (Tg) of less than −5° C., 1 to 20% by mass of a crosslinkable component, 0 to 19% by mass of a hard component having a glass transition temperature (Tg) of higher than 50° C. and 0 to 10% by mass of another component, is suitable as the elastic polymer to be impregnated into the microfine-fiber entangled body. By impregnating the above water-dispersible or water-soluble elastic polymer into the densified microfine-fiber entangled body having a high shape retention with little fiber pull-out, the leather-like sheet of the invention having a dense feeling, flexibility and surface appearance resembling natural leathers are obtained. Since the polymer of ethylenically unsaturated monomer is an elastic polymer of non-hydrogen bonded type, it is relatively less adhesive to the fibers, very flexible and largely deformable. Even when not impregnated with the elastic polymer, the microfine-fiber entangled body of the invention has a good dense feeling and napping appearance which are not obtained in the known nonwoven fabric not impregnated with the elastic polymer. Therefore, even if the polymer of ethylenically unsaturated monomer is impregnated into the bundles of microfine fibers or between the bundles of microfine fibers, the dense feeling is improved without impairing the flexibility.

Since the polymer of ethylenically unsaturated monomer has an extremely low tenacity as compared with the hydrogen-bonded polymer such as polyurethane, it has been known that a fiber entangled body impregnated with such polymer is low in mechanical properties and easily causes fiber pull-out. However, these drawbacks are free from in the present invention even if the polymer of ethylenically unsaturated monomer is impregnated into the microfine-fiber entangled body, because the microfine-fiber entangled body of the invention contains a number of thinner bundles of fibers in a high density, has a high shape retention, and little causes fiber pull-out. Namely, the use of the polymer of ethylenically unsaturated monomer has been made possible by the use of the microfine-fiber entangled body which is composed of bundles of microfine fibers containing microfine monofibers having an average cross-sectional area of 0.1 to 30 $\mu m^2$ and having an average cross-sectional area of 40 to 400 $\mu m^2$, in which the bundles of microfine fibers exist in a density of 600 to 4000/$mm^2$ on a cross section taken along the thickness direction of the microfine-fiber entangled body, and which preferably has a surface abrasion loss of 100 mg or less (measured by Martindale method with 50,000 abrasion cycles), an interlaminar peeling strength of 8 kg/2.5 cm or more, and a space filling of 0.25 to 0.60.

The polymer of ethylenically unsaturated monomer has a low hot-water resistance and a large swelling by hot-water. In the conventional method, to improve the process passing properties in the conversion to microfine fibers by hot water or in the dyeing process, it is required to impregnate the elastic polymer into the entangled nonwoven fabric to enhance the shape retention. However, if the conversion to microfine fibers by hot water or the dyeing process is performed after impregnating the polymer of ethylenically unsaturated monomer into the entangled nonwoven fabric, the polymer largely swells to fall off and the shape retention is lost. Therefore, the conversion to microfine fibers by hot water or the dyeing process cannot be effected without causing disadvantages, and the mechanical properties of resultant leather-like sheet are insufficient. In the present invention, the entangled nonwoven fabric can be subject to the conversion to microfine fibers by hot water without impregnating the elastic polymer, and the resultant microfine-fiber entangled body is dyed and then impregnated with the elastic polymer. Therefore, the problem due to the low hot-water resistance of the polymer of ethylenically unsaturated monomer is avoided.

The polymer of ethylenically unsaturated monomer is composed of a soft component, a crosslinkable component, a hard component and another component. The soft component is derived from a monomer, a homopolymer of which has a glass transition temperature (Tg) of less than −5° C., preferably −90° C. or more and less than −5° C., and more preferably −70° C. or more and less than −15° C., and is preferably non-crosslinkable (not forming crosslink). If the glass transition temperature (Tg) of the soft component is −5° C. or more, the hand of leather-like sheet is hard and the mechanical durability thereof such as flexing resistance is poor. The hard component is derived from a monomer, a homopolymer of which has a glass transition temperature (Tg) of higher than 50° C., preferably higher than 50° C. and 250° C. or less, and is preferably non-crosslinkable (not forming crosslink). If the glass transition temperature (Tg) of the hard component is 50° C. or less or the crosslinkable component is not contained, the polymer is largely adhesive. Therefore, the microfine fibers and bundles of fibers are bound and united together to impair the flexibility of leather-like sheet and the surface napping appearance of suede-finished artificial leather. In addition, the elastic polymer is largely swelled by attached water, solvent or sweat to reduce the practical performance.

In the polymer of ethylenically unsaturated monomer, the content of the soft component is 80 to 98% by mass, the content of the crosslinkable component is 1 to 20% by mass, the content of the hard component is 0 to 19% by mass, and the content of another component not included in any of the above components is 0 to 19% by mass. Particularly preferred polymer of ethylenically unsaturated monomer contains 85 to 96% by mass of the soft component, 1 to 10% by mass of the crosslinkable component and 3 to 15% by mass of the hard component. If the content of the soft component is less than 80% by mass or the total content of the crosslinkable component, the hard component and another component exceeds 20% by mass, the leather-like sheet tends to have a hard hand and becomes brittle. If the content of the soft component exceeds 98% by mass or the content of the crosslinkable component is less than 1% by mass, the polymer is highly adhesive and the microfine fibers are bound and united together, thereby deteriorating the flexibility of leather-like sheet and the surface napping appearance of suede-finished artificial leather. In addition, the polymer is largely swelled by attached water, solvent or sweat to reduce the practical performance.

The glass transition temperature (Tg) of the polymer of ethylenically unsaturated monomer may be determined by DSC (differential scanning calorimetry) or TMA (thermomechanical analysis) on a polymer having the same composition. Alternatively, calculated from the following formula 1:

$$1/Tg_t = w_1/Tg_1 + w_2/Tg_2 + \ldots + w_i/Tg_i \quad (1)$$

wherein $Tg_t$ is the glass transition temperature of the polymer, each of $w_1$ to $w_i$ is a fraction by mass of each of monomer components 1 to i in the polymer, and each of $Tg_1$ to $Tg_i$ is a glass transition temperature of homopolymer of each of monomer components 1 to i.

The glass transition temperature ($Tg_1$ to $Tg_i$) of each of the monomer components 1 to i is available from "Polymer Data Handbook (fundamental)", Baifukan Co., Ltd, "Polymer Handbook 3rd. edition", John Wiley & Sons, Inc. or other publications.

The glass transition temperature (Tg) of homopolymer of the typical ethylenically unsaturated monomer are:

methyl acrylate: 8° C., ethyl acrylate: −22° C., isopropyl acrylate: −5° C., n-butyl acrylate: −54° C., 2-ethylhexyl acrylate: −70° C., methyl methacrylate: 105° C., ethyl methacrylate: 65° C., isopropyl methacrylate: 81° C., n-butyl methacrylate: 20° C., isobutyl methacrylate: 6720 C., n-hexyl methacrylate: −5° C., lauryl methacrylate: −65° C., cyclohexyl methacrylate: 168° C., acrylic acid; 106° C., methacrylic acid: 130° C., maleic acid: 130° C., itaconic acid: 130° C., 2-hydroxyethyl methacrylate: 55° C., hydroxypropyl methacrylate: 26° C., 2-hydroxyethyl acrylate: −15° C., hydroxypropyl acrylate: −7° C., acrylamide: 153° C., diacetone acrylamide: 65° C., glycidyl methacrylate: 41° C., styrene: 104° C., vinyl acetate: 30° C., and acrylonitrile: 100° C. The glass transition temperature (Tg) may slightly vary according to the terminal structure and the molecular weight.

The solubility parameter of hard component (SP value) and the content of hard component (HS % by mass) preferably satisfy the following formula:

$$(SP\ \text{value}) \times (HS\%\ \text{by mass}) \leqq 4.0\ [J/cm^3]^{1/2}.$$

The solubility parameter (SP value) is a square root of a ratio of a cohesive energy density (ΔE) and a molecular volume (V) as shown below:

$$SP\ \text{value}=(\Delta E/V)^{1/2}.$$

The SP values of various functional groups and polymers have been determined by Fedor and others. SP values of typical polymers are shown below.

fluorine rubber: 14.9 $[J/cm^3]^{1/2}$,
silicone rubber: 14.9 to 15.5 $[J/cm^3]^{1/2}$,
polypropylene: 15.6 to 17.0 $[J/cm^3]^{1/2}$,
polyethylene: 15.8 to 17.2 $[J/cm^3]^{1/2}$,
isoprene rubber (IR): 16.6 $[J/cm^3]^{1/2}$,
butadiene rubber (BR): 16.5 to 17.6 $[J/cm^3]^{1/2}$,
styrene-butadiene rubber (SBR): 16.6 to 17.8 $[J/cm^3]^{1/2}$,
polystyrene: 17.4 to 21.1 $[J/cm^3]^{1/2}$,
butadiene-acrylonitrile copolymer (NBR): 17.6 to 21.5 $[J/cm^3]^{1/2}$,
polymethyl methacrylate: 18.2 to 19.4 $[J/cm^3]^{1/2}$,
nylon 12: 19.0 $[J/cm^3]^{1/2}$,
polyvinyl acetate and polyvinyl chloride: 18.8 to 19.6 $[J/cm^3]^{1/2}$,
polyurethane: 20 to 22 $[J/cm^3]^{1/2}$ (26 to 28 $[J/cm^3]^{1/2}$ for only hard component),
polyethylene terephthalate: 21.9 $[J/cm^3]^{1/2}$,
polyvinyl alcohol: 25.8 $[J/cm^3]^{1/2}$,
nylon 6: 25.9 $[J/cm^3]^{1/2}$,
nylon 66: 27.8 $[J/cm^3]^{1/2}$, and
polyacrylonitrile: 25 to 28 $[J/cm^3]^{1/2}$.

By multiplying the above values by 0.49, the SP values with a unit ($cal/cm^3$) conventionally used are obtained. Since the SP values slightly vary according to the small difference in the structure or the terminal structure, the values range to some extent.

The SP value is generally utilized as the measure for the solubility of polymer, the adhesive property between polymers and the cohesive property of molecules. If the (SP value)×(HS % by mass) is 4.0 $[J/cm^3]^{1/2}$ or less, the firm adhesion or bond between microfine fibers is prevented, thereby easily obtaining a leather-like sheet with a good flexibility and a high-quality suede-finished artificial leather having a good napping appearance. The SP value is preferably from 14 to 26 $[J/cm^3]^{1/2}$, although not limited thereto. The (SP value)×(HS % by mass) is more preferably from 0.5 to 4.0 $[J/cm^3]^{1/2}$ and still more preferably from 0.5 to 3.0 $[J/cm^3]^{1/2}$.

The monomers for constituting the soft component and hard component are selected according to the glass transition temperatures (Tg). Examples of the monomer for the soft component include (meth)acrylic acid derivatives such as ethyl acrylate, n-butyl acrylate, isobutyl acrylate, isopropyl acrylate, n-hexyl (meth)acrylate, 2-ethylhexyl (meth)acrylate, lauryl (meth)acrylate, stearyl (meth)acrylate, cyclohexyl acrylate, benzyl acrylate, 2-hydroxyethyl acrylate, and 2-hydroxypropyl acrylate. These monomers may be used alone or in combination of two or more.

Examples of the monomer for the hard component include (meth)acrylic acid derivatives such as methyl methacrylate, ethyl methacrylate, isopropyl methacrylate, isobutyl methacrylate, cyclohexyl methacrylate, (meth)acrylic acid, dimethylaminoethyl methacrylate, diethylaminoethyl methacrylate, and 2-hydroxyethyl methacrylate; aromatic vinyl compounds such as styrene, α-methylstyrene, and p-methylstyrene; acrylamides such as (meth)acrylamide and diacetone (meth)acrylamide; maleic acid, fumaric acid, itaconic acid and their derivatives; heterocyclic vinyl compounds such as vinylpyrrolidone; vinyl compounds such as vinyl chloride, acrylonitrile, vinyl ether, vinyl ketone and vinylamide; and α-olefin such as ethylene and propylene. These monomers may be used alone or in combination of two or more.

The glass transition temperature (Tg) may slightly vary according to the terminal structure and the molecular weight.

Examples of other copolymerizable components include (meth)acrylic acid derivatives such as methyl acrylate, n-butyl methacrylate, hydroxypropyl methacrylate, glycidyl (meth)acrylate, dimethylaminoethyl methacrylate, and diethylaminoethyl methacrylate.

The polymer of ethylenically unsaturated monomer preferably has a crosslinked structure. Since the polymer of ethylenically unsaturated monomer is a non-hydrogen-bonded polymer, the polymer is less cohesive as compared with the hydrogen-bonded polymer such as polyurethane elastomer. Therefore, if having no crosslinked structure, the polymer is largely swelled by attached water, solvent or sweat to impair the practical performance. The existence of the crosslinked structure is confirmed by measuring a storage elastic modulus as described below.

The crosslinkable component is a multifunctional ethylenically unsaturated monomer unit capable of forming a crosslinked structure, a monofunctional or multifunctional ethylenically unsaturated monomer unit having a reactive group capable of forming a crosslinked structure, or a compound (crosslinking agent) capable of forming a crosslinked structure by the reaction with the polymer of ethylenically unsaturated monomer. The content of the crosslinkable component is 1 to 20% by mass, preferably 1 to 10% by mass. If exceeding 20% by mass, the storage elastic modulus and loss elastic modulus are high, thereby hardening the hand and deteriorating the surface abrasion resistance and flexing resistance. If less than 1% by mass, the polymer of ethylenically unsaturated monomer becomes highly adhesive to bind or unite the microfine fibers, thereby deteriorating the flexibility of leather-like sheet and the surface napping appearance of suede-finished artificial leather. In addition, the polymer is largely swelled by attached water, solvent or sweat to impair the practical performance. It is preferred to adjust the logarithmic value of storage elastic modulus at 150° C. to 4.0 or more and the logarithmic value of loss elastic modulus at 150° C. to 3.0 to 6.0 Pa by suitably selecting the content of the crosslinkable component.

Examples of the multifunctional ethylenically unsaturated monomer include di(meth)acrylates such as ethylene glycol di(meth)acrylate, triethylene glycol di(meth)acrylate, polyethylene glycol di(meth)acrylate, 1,4-butanediol di(meth)acrylate, 1,6-hexanediol di(meth)acrylate, 1,9-nonanediol di(meth)acrylate, neopentyl glycol di(meth)acrylate, dimethylol tricyclodecane di(meth)acrylate, glycerin di(meth)acrylate; tri(meth)acrylates such as trimethylol propane tri(meth)acrylate and pentaerythritol tri(meth)acrylate; tetra(meth)acrylates such as pentaerythritol tetra(meth)acrylate; multifunctional vinyl compounds such as divinylbenzene and trivinylbenzene; (meth)acrylic unsaturated esters such as allyl (meth)acrylate and vinyl (meth)acrylate; and urethane acrylates having a molecular weight of 1500 or less such as 2:1 adduct of 2-hydroxy-3-phenoxypropyl acrylate and hexamethylene diisocyanate, 2:1 adduct of pentaerythritol triacrylate and hexamethylene diisocyanate, and 2:1 adduct of glycerin dimethacrylate and tolylene diisocyanate. These monomers may be used alone or in combination of two or more.

The monofunctional or multifunctional ethylenically unsaturated monomer having a reactive group capable of forming a crosslinked structure is not specifically limited as long as it has a functional group reactive with a crosslinking agent. Examples thereof include (meth)acrylic acid derivative having hydroxyl group such as 2-hydroxyethyl (meth)acrylate and 2-hydroxypropyl (meth)acrylate; acrylamides such as (meth)acrylamide and diacetone(meth)acrylamide; derivatives thereof; (meth)acrylic acid derivative having epoxy group such as glycidyl (meth)acrylate; vinyl compounds having carboxyl group such as (meth)acrylic acid, maleic acid, fumaric acid and itaconic acid; and vinyl compounds having amide group such as vinylamide. These monomers may be used alone or in combination of two or more.

The crosslinking agent is a water-soluble or water-dispersible compound having two or more functional groups capable of reacting with the functional group of the monomer units constituting the polymer of ethylenically unsaturated monomer. The combination of the functional group of the monomer unit and the functional group of the crosslinking agent may include carboxyl group and oxazoline group, carboxyl group and carbodiimide group, carboxyl group and epoxy group, carboxyl group and cyclocarbonate group, carboxyl group and aziridine group, carbonyl group and hydrazine derivative, and hydrazide derivative. Particularly preferred are the combination of a monomer unit having carboxyl group and a crosslinking agent having oxazoline group, carbodiimide group or epoxy group, the combination of a monomer unit having hydroxyl group or amino group and a crosslinking agent having a block isocyanate group, and the combination of a monomer unit having carbonyl group and a hydrazine derivative or hydrazide derivative, because these combinations do not contain or generate a trace of formalin, but prolong the pot life of the elastic polymer and easily form crosslink, and the resultant leather-like sheet has a good hand and excellent properties. The crosslinking agent may be a water-soluble or water-dispersible, self-crosslinking compound which does not react with the functional group of a monomer unit, for example, a polyisocyanate compound and a multifunctional block isocyanate compound.

The crosslinked structure is preferably formed in the heat treatment after impregnating the elastic polymer into the microfine-fiber entangled body in view of the stability of a liquid containing the elastic polymer and the effect on improvement by the crosslinked structure.

To further improve the fastness to light of the leather-like sheet, an ethylenically unsaturated monomer having a hindered amino group having a light-stabilizing effect and/or a ultraviolet-absorbing group may be copolymerized as another component mentioned above. Examples of such ethylenically unsaturated monomer include ethylenically unsaturated monomers having a hindered amino group such as 4-(meth)acryloyloxy-2,2,6,6-tetramethylpiperidine, 4-(meth)acryloyloxy-1,2,2,6,6-pentamethylpiperidine, 4-(meth)acryloylamino-2,2,6,6-tetramethylpiperidine, and 4-(meth)acryloylamino-1,2,2,6,6-pentamethylpiperidine; and ethylenically unsaturated monomers having benzotriazole group or benzophenone group such as 2-[2'-hydroxy-5'-(meth)acryloyloxyethylphenyl]-2H-benzotriazole, 2-hydroxy-4-(meth)acryloyloxybenzophenone, and 2-hydroxy-4-(meth)acryloyloxyethylbenzophenone.

The polymer of ethylenically unsaturated monomer composed of the above components is preferably a non-hydrogen-bonded polymer which is not crystallized or cohered by hydrogen bonding. The non-hydrogen-bonded polymer may partly contain a hard component capable of forming a hydrogen bonding as long as the polymer is not crystallized or cohered by the hydrogen bonding. The non-hydrogen-bonded polymer is selected from the following crystallizing polymers and their copolymers: polymers of (meth)acrylic acid derivative, (meth)acrylic acid derivative-styrene elastomers, (meth)acrylic acid derivative-acrylonitrile elastomers, (meth)acrylic acid derivative-olefin elastomers, (meth)acrylic acid derivative-(hydrogenated) isoprene elastomers, (meth)acrylic acid derivative-butadiene elastomers, styrene-butadiene elastomers, styrene-hydrogenated isoprene elastomers, acrylonitrile-butadiene elastomers, acrylonitrile-butadiene-styrene elastomers, polymers of vinyl acetate derivative, (meth)acrylic acid derivative-vinyl acetate elastomers, ethylene-vinyl acetate elastomers, ethylene-olefin elastomers, silicone elastomers such as silicone rubbers having a crosslinked structure, fluorine elastomers such as fluorine rubbers, and polyester elastomers. The polymer of ethylenically unsaturated monomer is preferably a polymer of (meth)acrylic acid derivative, and more preferably a polymer of (meth)acrylic acid derivative which is composed of 80 to 98% by mass of an acrylic acid derivative unit (soft component), 0 to 19% by mass of a methacrylic acid derivative unit and/or acrylonitrile derivative unit (hard component), 1 to 20% by mass of the crosslinkable component, and 0 to 19% by mass of another ethylenically unsaturated monomer unit (another component).

The polymer of ethylenically unsaturated monomer is preferably water-dispersible or water-soluble because an organic solvent is not needed and the environmental load is reduced, and more preferably water-dispersible because the water resistance is good. The polymer may be made water-dispersible or water-soluble by a known method such as a method in which an ethylenically unsaturated monomer having a hydrophilic group such as carboxyl group, sulfonic acid group and hydroxyl group is used and a method in which a surfactant is added to the elastic polymer containing the polymer in place of making the polymer of ethylenically unsaturated monomer itself water-dispersible or water-soluble. A surfactant having an ethylenically unsaturated group, a so-called reactive surfactant is usable. Examples of the surfactants include anionic surfactants such as sodium laurylsulfate, ammonium laurylsulfate, sodium polyoxyethylene tridodecyl ether acetate, sodium dodecylbenzenesulfonate, sodium alkyl diphenyl ether disulfonate, and sodium dioctylsulfosuccinate; and nonionic surfactants such as polyoxyethylene nonyl phenyl ether, polyoxyethylene octyl phenyl ether, polyoxyethylene lauryl ether, polyoxyethylene stearyl ether, and polyoxyethylene-polyoxypropylene block copolymer. By suitably selecting the cloud point of the surfactant, the polymer can be made heat-gelling. If the polymer is water-dispersible, the average size of dispersed particles is preferably 0.01 to 1 μm and more preferably 0.03 to 0.5 μm.

The logarithmic value of storage elastic modulus (Sm) at 50° C. of the polymer of ethylenically unsaturated monomer is preferably 4.0 to 6.5 Pa and more preferably 4.5 to 6.0 Pa. If exceeding 6.5 Pa, the hand becomes hard. Generally, the modulus at 100% elongation is frequently used as the measure for the flexibility of elastic polymer. However, the elastic polymer in the microfine-fiber entangled body is rarely to be elongated by 100%. Therefore, the rigidity or modulus of elasticity at micro-deformation is suitable as the measure for the flexibility of leather-like sheet, and the storage elastic modulus at room temperature (25° C.) to around 60° C., particularly around 50° C. is most suitable. The storage elastic modulus at 50° C. may be measured on a film of about 300 μm thick prepared by heat-treating a dried elastic polymer at about 140° C. using a viscoelasticity measuring device (FT Rheospectoler "DVE-V4" manufactured by Rheology Co. Ltd.) under the conditions of 11 Hz frequency, tensile mode and temperature rising rate of 3° C./min.

The logarithmic value of loss elastic modulus (Le) at 50° C. of the polymer of ethylenically unsaturated monomer is preferably 3.0 to 6.0 Pa and more preferably 4.0 to 5.5 Pa. The loss elastic modulus is a measure for the viscosity and plastic deformation of polymers, and polymers become resistant to plastic deformation as the loss elastic modulus is increased. If exceeding 6.0 Pa, the elastic polymer is difficult to be deformed when gripping the leather-like sheet by hand and the hand becomes hard. In addition, the elastic polymer is brittle and easily falls off to deteriorate the surface abrasion resistance. when Le is 3.0 to 6.0 Pa, since the elastic polymer is easily subject to plastic deformation by heat, pressure or mechanical stress (showing stretching properties), the elastic polymer does not fall off. Similarly to the measurement of the storage elastic modulus, the loss elastic modulus at 50° C. may be measured on a film of about 300 μm thick prepared by heat-treating a dried elastic polymer at about 140° C. using a viscoelasticity measuring device (FT Rheospectoler "DVE-V4" manufactured by Rheology Co. Ltd.) under the conditions of 11 Hz frequency, tensile mode and temperature rising rate of 3° C./min.

The polymer of ethylenically unsaturated monomer having both Sm and Le within the above ranges is particularly preferred. The glass transition temperature (Tg) of the polymer of ethylenically unsaturated monomer is preferably 0° C. or less.

The elastic polymer used in the present invention contains at least one polymer of ethylenically unsaturated monomer in an amount of 30 to 100% by mass. Another component may be the following polyurethane resin. By combinedly using the polyurethane resin, the adhesion of elastic polymer and the bundling of microfine fibers, i.e., the flexibility of leather-like sheet, the napping appearance of suede-finished artificial leather and the process passing properties can be controlled. The polymer of ethylenically unsaturated monomer and the polyurethane resin may be impregnated into the microfine-fiber entangled body after mixing or separately. When the polyurethane resin is combinedly used, a crosslinking agent capable of reacting with both the polymer of ethylenically unsaturated monomer and the polyurethane resin may be combinedly used, because the adhesion and film-forming properties of the polymer of ethylenically unsaturated monomer and the polyurethane resin are improved, thereby making the quality of the leather-like sheet more stable. If the content of the polymer of ethylenically unsaturated monomer is less than 30% by mass, the microfine fibers are unitedly bundled by the elastic polymer to make the hand of leather-like sheet hard and deteriorate the napping appearance of suede-finished artificial leather, durability and abrasion resistance.

The polyurethane resin may be a known polyurethane, for example, a polyurethane resin produced from a polymer polyol, an organic polyisocyanate and a chain extender as the main raw materials.

The polymer polyol is selected from known polymer polyols according to the final use and required properties. Examples thereof include polyether polyols and their copolymers such as polyethylene glycol, polypropylene glycol, polytetramethylene glycol, and poly(methyltetramethylene glycol); polyester polyols and their copolymers such as polybutylene adipate diol, polybutylene sebacate diol, polyhexamethylene adipate diol, poly(3-methyl-1,5-pentylene adipate) diol, poly(3-methyl-1,5-pentylene sebacate) diol, and polycaprolactone diol; polycarbonate polyols and their copolymers such as polyhexamethylene carbonate diol, poly (3-methyl-1,5-pentylene carbonate) diol, polypentamethylene carbonate diol, and polytetramethylene carbonate diol; and polyester carbonate polyols. These polymer polyols may be used alone or in combination of two or more. The combined use of two or more of non-crystallizing polycarbonate polyol, polyether polyol, polyester polyol and polycarbonate polyol is preferred because the durability of resultant leather-like sheet such as fastness to light, fastness to heat, resistance to NOx yellowing, resistance to sweat and resistance to hydrolysis are improved.

The organic diisocyanate is selected from known diisocyanates according to the final use and required properties. Examples thereof include non-yellowing diisocyanates composed of an aliphatic or alicyclic diisocyanate having no aromatic ring such as hexamethylene diisocyanate, isophorone diisocyanate, norbornene diisocyanate, and 4,4'-dicyclohexylmethane diisocyanate; known aromatic diisocyanates used as the diisocyanate component of polyurethane such as 2,4-tolylene diisocyanate, 2,6-tolylene diisocyanate, 4,4'-diphenylmethanediisocyanate, and xylylene diisocyanate, with the non-yellowing diisocyanates being preferred because the yellowing by light and heat hardly occurs.

The chain extender is selected from known chain extenders used in the production of urethane resins according to the final use and required properties. Examples thereof include diamines such as hydrazine, ethylenediamine, propylenediamine, hexamethylenediamine, nonamethylenediamine, xylylenediamine, isophoronediamine, piperazine and its derivatives, dihydrazide of adipic acid, dihydrazide of isophthalic acid; triamines such as diethylenetriamine; tetramines such as triethylenetetramine; diols such as ethylene glycol, propylene glycol, 1,4-butanediol, 1,6-hexanediol, 1,4-bis(β-hydroxyethoxy)benzene, and 1,4-cyclohexanediol; toriols such as trimethylolpropane; pentaols such as pentapentaerythritol; and amino alcohols such as aminoethyl alcohol and aminopropyl alcohol. These chain extenders may be used alone or in combination of two or more. Of the above, the combined use of two to four of hydrazine, piperazine, hexamethylenediamine, isophoronediamine and its derivatives, and triamine such as ethylenetriamine is preferred, because the film-forming properties are good and the coagulation of elastic polymer is completed by a short heat treatment after impregnation. The combined use of hydrazine and its derivatives having a anti-oxidation effect is particularly preferred in view of enhancing the durability. During the chain extending reaction, a monoamine such as ethylamine, propylamine and butylamine; a carboxyl group-containing amine compound such as 4-aminobutanoic acid and 6-aminohexanoic acid; or a monool such as methanol, ethanol, propanol and butanol may be combinedly used together with the chain extender.

To regulate the size of water dispersed particles and impart various performances, ionic group such as carboxyl group may be introduced into the backbone of polyurethane resin, for example, by combinedly using as a raw material for the urethane resin a carboxyl group-containing diol such as 2,2-bis(hydroxymethyl)propionic acid, 2,2-bis(hydroxymethyl) butanoic acid and 2,2-bis(hydroxymethyl)valeric acid.

The elastic polymer used in the present invention may be added with penetrant, defoaming agent, lubricant, water repellent, oil repellent, thickener, bulking agent, curing promoter, antioxidant, ultraviolet absorber, fluorescent agent, antimold agent, foaming agent, water-soluble polymer such as polyvinyl alcohol and carboxymethylcellulose, dye, pigment, etc. as long as the properties of resultant leather-like sheet is not adversely affected.

The impregnation of the elastic polymer into the microfine-fiber entangled body may be carried out by a known method. The elastic polymer may be impregnated uniformly throughout the microfine long fiber entanglement body, or may be impregnated with a density gradient in the thickness direction by migrating the elastic polymer to the surface or applying the elastic polymer on only one of the surfaces. The drying is preformed by a heat treatment in a dryer at 50 to 200° C. or may be conducted after a hot water treatment at 70 to 100° C. or a steam treatment at 70 to 200° C.

After impregnating the elastic polymer and drying, the polymer of ethylenically unsaturated monomer is required to substantially bond to the microfine fibers in the bundles, because the shape retention is further improved and the fiber pull-out is further reduced to increase the abrasion resistance. In addition, the structure of the leather-like sheet closely resembles the microfibril structure of natural leathers, thereby having a good dense feeling. By impregnating the elastic polymer into the microfine-fiber entangled body by a known method, the elastic polymer is bonded to the microfine fibers in the bundles. The words "the elastic polymer is bonded" mean that each of bundles of microfine fibers has the adhered portion between the elastic polymer and the microfine fibers. The elastic polymer may partly adhere to the microfine fibers to partly leave a space between the elastic polymer and the microfine fibers. If the elastic polymer does not bond to the microfine fibers in the bundles, the fiber pull-out is likely to occur to reduce the surface abrasion resistance and impair the dense feeling.

To obtain a uniform bonding of the elastic polymer to the microfine fibers, it is preferred to prevent or control the migration of the elastic polymer. The prevention or control of the migration is effected by reducing the stability of water dispersion at about 40 to 100° C. The stability of water dispersion is reduced by regulating the particle size of the elastic polymer in a water dispersion or by combinedly using a mono or divalent alkali metal salt or alkaline earth metal salt, a nonionic emulsifier, an associating, a heat-gelling agent such as an associating water-soluble thickener and a water-soluble silicone compound, or a water-soluble polyurethane compound. Particularly, it is preferred to add the nonionic emulsifier and/or the associating, water soluble thickener to the elastic polymer. The elastic polymer may be allowed to migrate, if necessary, so as to incline the distribution of elastic polymer to the surface.

The elastic polymer is impregnated preferably in a ratio, microfine-fiber entangled body:elastic polymer, of 100:0 to 70:30 by mass. Within the above range, the flexibility of leather-like sheet, dense feeling, surface appearance, and surface properties are good. The microfine-fiber entangled body of the invention is usable as the substrate for artificial leathers without providing the elastic polymer, because its shape retention is extremely good. If the amount of the elastic polymer to be impregnated exceeds 30% by mass, a hand resembling natural leathers is difficult to obtain and the napping appearance of suede-finished artificial leather is poor. The ratio of the fiber entangled body and the elastic polymer is more preferably 99.5:0.5 to 80:20 by mass because the shape retention and the effect of preventing fiber pull-out are good.

The apparent density of leather-like sheet is preferably 0.35 to 0.8 g/cm$^3$ because the dense feeling, napping appearance of suede-finished artificial leather, writing effect and napping density are good, and more preferably 0.40 to 0.7 g/cm$^3$. If necessary, the thickness of leather-like sheet may be regulated to a desired level by pressurizing, heating or slicing. Before or after converting the microfine fiber-forming fibers to microfine fibers, at least one surface of the leather-like sheet may be napped by a known method using a sand paper or card clothing, to obtain a suede-finished artificial leather having surface naps mainly composed of the microfine fibers. If necessary, a finishing treatment such as a flexibilizing treatment by crumpling, a reverse seal brushing, and a glazing treatment by friction melting may be performed. The denseness of surface napping and the smoothness of surface may be improved by heat-pressing or embossing. By shortening the length of napped fiber as compared with that of suede-finished artificial leather, a nubuck artificial leather is obtained.

Since the polymer of ethylenically unsaturated monomer is well deformable by heat or pressure, the surface of leather-like sheet can be densified by pressure or heat without additionally providing a resin on the surface layer, thereby obtaining a density gradient resembling natural leathers. It is preferred that the density gradient thus obtained meets the following requirements: the existence density of bundles of microfine fibers in the surface layer within a depth of 0.2 mm from the surface is 1000 to 5000/mm$^2$; and the ratio of the existence density of bundles of microfine fibers in the surface layer and the existence density of bundles of microfine fibers in the lower layer within a depth of 0.2 mm or more from the surface (existence density in surface layer/existence density in lower layer) is 1.3 to 5.0. The existence density of bundles of microfine fibers is the number of bundles of microfine fibers per 1 mm$^2$ on a cross section taken along the thickness direction of the fiber entangled body. If the ratio exceeds 5.0, the hand is felt hard in some cases. The ratio is more preferably 2.0 to 3.0 because the surface smoothness and dense feeling are good. If the existence density of bundles of microfine fibers in the surface layer is less than 1000/mm$^2$, the denseness of surface tends to be poor. If exceeding 5000/mm$^2$, the bundles of microfine fibers are easily unitedly bundled.

As describe above, since the polymer of ethylenically unsaturated monomer is well deformable, the surface of leather-like sheet can be smoothed by pressure or heat without additionally providing a resin on the surface layer. By such smoothing, a grain-finished artificial leather, semi grain-finished artificial leather, or nubuck artificial leather with a short surface naps are obtained, each having a surface (grain portion or grain layer) which is mainly formed from a densified layer comprising a united composite of the microfine fibers and the elastic polymer and contains fine pores having an average pore size of 50 μm or less in a density of 20/cm$^2$ or more. The artificial leather of the invention having the above structure has properties not found in known artificial leathers, i.e., a hand, dense feeling and surface appearance each closely resembling natural leathers and is excellent in the air permeability and water vapor permeability. If the content of the polymer of ethylenically unsaturated monomer in the elastic polymer is less than 30% by mass, the deformation by pressure or heat is difficult. Therefore, the surface is difficult to be densified and the pore size increases, to deteriorate the compact feeling, smoothness, high quality and dense feeling of the surface. If the average cross-sectional area of single fibers is less than 0.1 μm$^2$, the color development may be insufficient. If exceeding 30 μm$^2$, the surface smoothness may be poor or the pore size may increase. If the pore size exceeds 50 μm, the surface smoothness and high quality may be poor. In addition, water may easily penetrate to deteriorate the practical performance. If the density of fine pores is less than 20/cm$^2$, the air permeability and water vapor permeability are reduced. Particularly preferred is a grain-finished artificial leather in which the average cross-sectional area of single fibers is 0.5 to 20 μm$^2$, the content of the polymer of ethylenically unsaturated monomer in the elastic polymer is 50 to 100% by mass, the surface layer contains fine pores having an average pore size of 30 μm or less in a density of 100/cm$^2$ or more, and the surface layer is composed of a united composite of the microfine fibers and the elastic polymer not forming a continuous layer.

A grain-finished or semi grain-finished artificial leather may be also obtained by forming a skin layer on the surface of leather-like sheet or suede-finished artificial leather by a known method during or after impregnating the elastic polymer into the microfine long-fiber entangled body, and then conducting a known fishing treatment such as dyeing, embossing, flexibilizing, and wet flexibilizing. If necessary, the leather-like sheet of the invention (upper layer) may be laminated with a knitted or woven fabric (lower layer), or the suede-finished artificial leather of the invention (upper layer) may be laminated with a layer (lower layer) made of fibers different from the fibers constituting the suede-finished artificial leather.

EXAMPLES

The present invention will be described by reference to the examples. However, it should be noted that the scope of the invention is not limited thereto. In the following, "part" and "%" are based on mass as far as otherwise noted. The evaluations were made in the following methods.

(1) Average Cross-Sectional Areas of Single Fibers and Bundles of Microfine Fibers A cross section taken along the thickness direction of a leather-like sheet was dyed with osmium oxide and observed under a scanning electron microscope (1000 to 3000 magnitude). The cross-sectional areas of microfine monofibers and bundles of microfine fibers each being nearly perpendicular to the cross section were measured. The measurement was repeated on 10 or more cross sections while varying the positions for taking the cross sections randomly and varying the positions of the microfine monofibers and bundles of microfine fibers randomly. The results are shown by average values.

(2) Existing Density of Bundles of Microfine Fibers

A cross section taken along the thickness direction of a leather-like sheet was dyed with osmium oxide and observed under a scanning electron microscope (200 to 500 magnitude). The different positions were observed such that the total area observed was 0.5 $mm^2$ or more, and the number of the bundles of microfine fibers nearly perpendicular to the cross section was counted. From the measured number, the number of bundles of microfine fibers per 1 $mm^2$ was calculated. The measurement was repeated on 10 or more cross sections while varying the positions for taking the cross sections randomly and varying the positions of the microfine monofibers and bundles of microfine fibers randomly. The results are shown by average values.

(3) Bonding of Elastic Polymer

A cross section of a leather-like sheet was dyed with osmium oxide and observed under a scanning electron microscope (500 to 2000 magnitude). The observation was made on 10 or more positions to evaluate the bonding state of the elastic polymer to the bundles of microfine fibers and microfine fibers.

(4) Pore Size and Number of Pores on Surface of Leather-Like Sheet

The surface of a leather-like sheet was dyed with osmium oxide and observed under a scanning electron microscope (200 to 1000 magnitude). The different positions were observed such that the total area observed was 0.5 $mm^2$ or more, and the number of pores per 1 $mm^2$ was counted. The measurement was repeated on 10 or more positions randomly selected. The results are shown by average values.

(5) Melting Point of Thermoplastic Resin

The peak top temperature of the endothermic peak was measured using a differential scanning calorimeter (TA3000 available from Mettler Inc.) by heating a resin to 300° C. at a rate of 10° C./min in a nitrogen atmosphere, then cooling to room temperature, and then heating again to 300° C. at a rate of 10° C./min.

(6) Interlaminar Peeling Strength

On the length-wise end surface of a test piece of 28 cm in the length direction (machine direction of the sheet) and 2.5 cm in the width direction, a slit was made by cutting with a razor along the line at nearly the central position in the thickness direction. Then, the test piece was peeled from the slit about by 10 cm by hands. The edges of two peeled portions were cramped by chucks and the test piece was peeled away using a tensile tester at a pulling speed of 100 mm/min. The peeling strength was determined from the stress in the flat portion of the obtained stress-train curve (SS curve). The results were given by the average on three test pieces.

(7) Surface Abrasion Loss (Martindale Method, Abrasion Cycles: 50,000)

The abrasion loss was measured according to JIS L1096 (8.17.5E method, Martindale method) under a load of 12 kPa ($gf/cm^2$) and 50,000 abrasion cycles.

(8) Fastness to Wet Friction

The measurement was made according to JIS L0801 and evaluated by the ratings.

(9) Tear Strength

A slit of 5 cm long was made on a test piece of 10 cm×4 cm from the center of the shorter side along the direction perpendicular to the shorter side. The each slit end was cramped by chuck and torn using a tensile tester at a speed of 10 cm/min to obtain the maximum tearing load, which was then divided by the mass per unit area of the test piece. The obtained value was converted to the value corresponding to the test piece having a mass per unit area of 100 $g/m^2$ and the converted value was employed as the tear strength. The results were given by the average on three test pieces.

(10) Storage Elastic Modulus and Loss Elastic Modulus of Cast Film

An emulsion was dried at 50° C. to obtain a film of 200 μm thick which was then heat-treated at 130° C. for 30 min. The storage elastic modulus and loss elastic modulus at 50° C. of the film thus obtained were measured using a viscoelasticity measuring device (FT Rheospectoler "DVE-V4" manufactured by Rheology Co. Ltd.) under the conditions of 11 Hz frequency and temperature rising rate of 3° C./min.

(11) Air Permeability

According to JIS L1096-8.27.1A method, the amount of air permeated ($cc/(cm^2 \cdot s)$) was measured using a Frazier-type tester.

(12) Water Vapor Permeability

According to JIS K-6549, the amount of water vapor passed ($g/(m^2 \cdot 24\ h)$) was measure by a cup method using calcium chloride.

Production Example 1

Production of Water-Soluble, Thermoplastic Polyvinyl Alcohol Resin

A 100-L pressure reactor equipped with a stirrer, a nitrogen inlet, an ethylene inlet and an initiator inlet was charged with 29.0 kg of vinyl acetate and 31.0 kg of methanol. After raising the temperature to 60° C., the reaction system was purged with nitrogen by bubbling nitrogen for 30 min. Then, ethylene was introduced so as to adjust the pressure of the reactor to 5.9 $kgf/cm^2$. A 2.8 g/L methanol solution of 2,2'-azobis(4-methoxy-2,4-dimethylvaleronitrile) (initiator) was purged with nitrogen by nitrogen gas bubbling. After adjusting the temperature of reactor to 60° C., 170 mL of the initiator solution was added to initiate the polymerization. During the polymerization, the pressure of reactor was maintained at 5.9 kgf/cm$^2$ by introducing ethylene, the polymerization temperature was maintained at 60° C., and the initiator solution was continuously added at a rate of 610 mL/h. When the conversion of polymerization reached 70% after 10 h, the polymerization was terminated by cooling. After releasing ethylene from the reactor, ethylene was completely removed by bubbling nitrogen gas. The non-reacted vinyl acetate monomer was removed under reduced pressure to obtain a methanol solution of ethylene-modified polyvinyl acetate (modified PVAc), which was then diluted to 50% concentration with methanol. To 200 g of the 50% methanol solution of the modified PVAc, 46.5 g of a 10% methanol solution of NaOH was added to carry out a saponification (0.10 mol of NaOH per 1 mol of vinyl acetate unit in the modified PVAc). After about 2 min of the addition of NaOH, the system was gelated. The gel was crushed by a crusher and allowed to stand at 60° C. for one hour to allow the saponification to further proceed. Then, 1000 g of methyl acetate was added to neutralize the remaining NaOH. After confirming the completion of neutralization by phenolphthalein indicator, white solid was separated by filtration. The white solid was added with 1000 g of methanol and allowed to stand at room temperature for 3 h for washing. After repeating the above washing operation three times, the solvent was centrifugally removed and the solid remained was dried in a dryer at 70° C. for 2 days to obtain an ethylene-modified polyvinyl alcohol (modified PVA). The saponification degree of the modified PVA was 98.4 mol %. The modified PVA was incinerated and dissolved in an acid for analysis by atomic-absorption spectroscopy. The content of sodium was 0.03 part by mass based on 100 parts by mass of the modified PVA.

After repeating three times the precipitation-dissolution operation in which n-hexane is added to the methanol solution of the modified PVA and acetone is then added for dissolution, the precipitate was vacuum-dried at 80° C. for 3 days to obtain a purified, modified PVAc. The purified, modified PVAc was dissolved in d6-DMSO and analyzed by 500 MHz H-NMR (JEOL GX-500) at 80° C. The content of ethylene unit was 10 mol %. After saponifying the purified, modified PVAc (alkali/vinyl acetate units=0.5 by mol), the gel was crushed and the saponification was allowed to further proceed by standing at 60° C. for 5 h. The saponification product was extracted by Soxhlet with methanol for 3 days and the obtained extract was vacuum-dried at 80° C. for 3 days to obtain a purified, modified PVA. The average polymerization degree of the purified, modified PVA was 330 when measured by a method of JIS K6726. The content of 1,2-glycol linkage and the content of three consecutive hydroxyl groups in the purified, modified PVA were respectively 1.50 mol % and 83% when measured by 5000 MHz H-NMR (JEOL GX-500). A 5% aqueous solution of the purified, modified PVA was made into a cast film of 10 μm thick, which was then vacuum-dried at 80° C. for one day and then measured for the melting point in the manner described above. The melting point was 206° C.

Example 1

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 25/fiber) at 260° C. in a sea component/island component ratio of 20/80 (by mass). The ejector pressure was adjusted such that the spinning speed was 4000 m/min, and long fibers having an average fineness of 2.0 dtex were collected on a net, to obtain a spun bonded sheet (long fiber web) having a mass per unit area of 30 g/m$^2$.

A superposed web of 12 spun bonded sheets prepared by crosslapping was sprayed with an oil agent for preventing needle break, and then needle-punched in a density of 1800 punch/cm$^2$ using needles of #42 gauge having one barb and needles of #42 gauge having six barbs, to entangle the superposed web. The areal shrinkage by the needle punching was 20% and the mass per unit area of the long-fiber entangled nonwoven fabric after needle punching was 450 g/m$^2$ and the interlaminar peeling strength was 9.0 kg/2.5 cm.

The long fiber-entangled nonwoven fabric was immersed in a hot water of 70° C. for 90 s to allow the nonwoven fabric to areal-shrink by utilizing the stress relaxation of the island component. Then, the nonwoven fabric was immersed in a hot water of 95° C. for 10 min to remove the modified PVA by dissolution, thereby obtaining a microfine long-fiber entangled body. After drying, the areal shrinkage was 45%, the mass per unit area was 820 g/m$^2$, and the apparent density was 0.53 g/cm$^3$. The Martindale abrasion loss was 30 mg, the interlaminar peeling strength was 13 kg/2.5 cm, the tear strength per 100 g/m$^2$ was 1.2 kg, and the average single fiber fineness of the microfine long fibers was 0.1 dtex. Thus, the microfine long-fiber entangled body had properties sufficient for withstanding the next dyeing process.

The microfine long-fiber entangled body was dyed with 8% owf of a disperse dye to gray and napped by buffing. The fiber pull-out and fray during the dyeing and the fiber pull-out during the buffing were not observed, and the process passing properties were good. The thickness was 1.2 mm, the mass per unit area was 625 g/m$^2$, and the apparent density was 0.42 g/cm$^3$. Upon the observation of a cross section of the sheet under a scanning electron microscope, the average cross-sectional area of single fiber was 7 μm$^2$, the average cross-sectional area of bundles of microfine long fibers was 170 μm$^2$, and the average existence density of bundles of microfine fibers was 1000/mm$^2$. The Martindale abrasion loss was 50 mg, the interlaminar peeling strength was 13 kg/2.5 cm, and the tear strength per 100 g/m$^2$ was 1.2 kg. Thus, a dyed microfine long-fiber entangled body having a good dense feeling and color development with little fiber pull-out was obtained.

The dyed microfine long-fiber entangled body was impregnated with a water dispersion (solid concentration; 6%) of the following (meth)acrylic acid derivative polymer capable of forming a crosslinked structure in a microfine long-fiber entangled body/elastic polymer ratio of 96:4 by mass and then dried at 140° C., to obtain a leather-like sheet having an apparent density of 0.43 g/cm$^3$.

(Meth)Acrylic Acid Derivative Polymer

Glass transition temperature Tg of soft component: −30° C.

Glass transition temperature Tg of hard component: 105° C.

Logarithmic value of storage elastic modulus at 50° C.: 5.5 Pa

Logarithmic value of loss elastic modulus at 50° C.: 4.5 Pa

Soft component/crosslinkable component/hard component (by mass): 89/3/8

SP value of hard component: 18.2 to 19.4 [J/cm$^3$]$^{1/2}$

By napping the surface by buffing, water washing and sealing treatment, a suede-finished artificial leather having a dense feeling resembling natural leathers and a elegant napping appearance was obtained.

The microfine long fibers in the obtained suede-finished artificial leather were dyed, but the elastic polymer was substantially not dyed. The elastic polymer was bonded to the inside and around outer surface of the bundles of microfine long fibers. The average cross-sectional area of single fiber was 7 $\mu m^2$, the average cross-sectional area of bundles of fibers was 150 $\mu m^2$, and the average existence density of bundles of fibers was 1000/$mm^2$. The surface abrasion loss was 20 mg, and the fastness to wet friction was Grade 4. Thus, the suede-finished artificial leather had properties suitable for interior or clothes application.

Example 2

A suede-finished artificial leather was produced in the same manner as in Example 1 except for using a shrinkable polyamide as the island component of microfine fibers-forming long fibers; dyeing with a gray metal complex dye; changing the solid concentration of the water dispersion of the elastic polymer to 15%; and changing the ratio of the microfine long-fiber entangled body and the elastic polymer to 90:10 by mass. The dyed microfine long-fiber entangled body before impregnated with the elastic polymer had an apparent density of 0.45 g/$cm^3$, a Martindale abrasion loss of 60 mg, an interlaminar peeling strength of 12 kg/2.5 cm, and a tear strength of 1.2 kg per 100 g/$m^2$. The obtained suede-finished artificial leather had an apparent density of 0.44 g/$cm^3$, a Martindale abrasion loss of 70 mg, an interlaminar peeling strength of 2 kg/2.5 cm, and a tear strength of 1.2 kg per 100 g/$m^2$. In the obtained suede-finished leather-like sheet, the microfine long fibers are dyed, but the elastic polymer was not substantially dyed. The elastic polymer was bonded to the inside and around outer surface of the bundles of microfine long fibers. The average cross-sectional area of single fiber was 7 $\mu m^2$, the average cross-sectional area of bundles of fibers was 150 $\mu m^2$, and the average existence density of bundles of fibers was 800/$mm^2$. The suede-finished leather-like sheet has a good flexibility. The surface abrasion loss was 30 mg, the fastness to wet friction was Grade 4. Thus, the suede-finished artificial leather had properties suitable for shoes and clothes application.

Comparative Example 1

A leather-like sheet was produced in the same manner as in Example 1 except for using microfine fiber-forming short fibers having a fineness of 4.0 dtex in place of the microfine fiber-forming long fibers. The microfine-fiber entangled body was largely extended during the dyeing operation to frequently cause fiber pull-out. The average cross-sectional area of single fiber was 1.6 $\mu m^2$, and the average cross-sectional area of bundles of fibers was 350 $\mu m^2$. However, the existence density of bundles of microfine fibers was only 300/$mm^2$, and therefore, the dense feeling and surface appearance were extremely poor. Although the apparent density of microfine-fiber entangled body was 0.30 g/$cm^3$, the interlaminar peeling strength was 2 kg/2.5 cm and the surface abrasion loss was 250 mg.

Comparative Example 2

A leather-like sheet containing no bundles of fibers was produced in the same manner as in Example 1 except for preparing a spun bonded sheet (long fiber web) having a mass per unit area of 30 g/$m^2$ by collecting, in place of microfine fiber-forming long fibers, polyethylene terephthalate long fibers having an average fineness of 0.2 dtex on a net. Since the entanglement was insufficient, the microfine-fiber entangled body had an apparent density of 0.25 g/$cm^3$, an interlaminar peeling strength of 2 kg/2.5 cm, and a surface abrasion loss of 200 mg or more. The fiber entangled body was largely extended during the dyeing operation to frequently cause fiber pull-out. The average cross-sectional area of single fiber was 20 $\mu m^2$ and the existence density of bundles of microfine fibers was 300/$mm^2$. Therefore, the dense feeling and surface appearance were extremely poor.

Comparative Example 3

A leather-like sheet was produced in the same manner as in Example 1 except for subjecting the entangled nonwoven fabric to areal shrinking by 40% at 70° C. and 90% RH, drying at 120° C., impregnating the elastic polymer, and then converting to microfine fibers. The fiber pull-out frequently occurred and the sheet had marked uneven naps and uneven color. Therefore, the obtained sheet was poor in quality. The fastness to wet friction was as low as Grade 2. The elastic polymer did not exist in the bundles of microfine long fibers, but existed only around the outer surface of the bundles of fibers.

Comparative Example 4

A suede-finished artificial leather was produced in the same manner as in Example 1 except for changing the number of islands to 4. The average cross-sectional area of single fiber was 50 $\mu m^2$, the surface napping appearance was coarse, and the touch was rough. Thus, the suede-finished artificial leather was poor in quality.

Comparative Example 5

A suede-finished artificial leather was produced in the same manner as in Example 1 except for using microfine fiber-forming long fibers having an average fineness of 6.0 dtex. The average cross-sectional area of single fiber was 18 $\mu m^2$, the average cross-sectional area of bundles of microfine fibers was 520 $\mu m^2$, the apparent density was 0.40 g/$cm^3$, the interlaminar peeling strength was 9 kg/2.5 cm, and the surface abrasion loss was 120 mg. The surface napping appearance was coarse and the touch was rough. Thus, the suede-finished artificial leather was poor in quality.

Comparative Example 6

A suede-finished artificial leather was produced in the same manner as in Example 1 except for changing the water dispersion of (meth)acrylic acid derivative polymer to a water dispersion of non-crystallizing polycarbonate/polyether polyurethane (hydrogen-bonded polymer; SP value of hard component=26 to 28 $[J/cm^3]^{1/2}$). The hand was hard, the napping appearance was poor, and the surface touch was poor. The elastic polymer was bonded to the inside and around outer surface of the bundles of microfine long fibers. However, as compared with Example 1, the bundles of fibers were adhesively bound and microfine fibers were united. Therefore, the average cross-sectional area of single fiber was substantially over 45 $\mu m^2$.

Example 3

A nubuck artificial leather was produced in the same manner as in Example 1 except for changing the elastic polymer to a water dispersion (solid concentration: 15%) of the following (meth)acrylic acid derivative-acrylonitrile polymer capable of forming a crosslinked structure, and changing the ratio of the microfine long-fiber entangled body and the impregnated elastic polymer to 88:12 by mass.

(Meth)Acrylic Acid Derivative-Acrylonitrile Polymer

Glass transition temperature Tg of soft component: −35° C.

Glass transition temperature Tg of hard component: 103° C.

Logarithmic value of storage elastic modulus at 50° C.: 5.2 Pa

Logarithmic value of loss elastic modulus at 50° C.: 4.2 Pa

Soft component/crosslinkable component/hard component (by mass): 94/3/3

SP value of hard component: 23 to 24 $[J/cm^3]^{1/2}$

The obtained nubuck artificial leather had shorter naps as compared with Example 1. The dense feeling resembled natural leathers and the napping appearance was elegant. In the nubuck artificial leather, the microfine long fibers were dyed, but the elastic polymer was substantially not dyed. The elastic polymer was bonded to the inside and around outer surface of the bundles of microfine long fibers. The average cross-sectional area of single fiber and the average cross-sectional area of bundles of microfine fibers were the same as those of Example 1. The surface abrasion loss was 20 mg and the fastness to wet friction was Grade 4. Thus, the nubuck artificial leather had properties suitable for interior, car seat and shoes application.

Example 4

A leather-like sheet was produced in the same manner as in Example 3 except for smoothing the microfine-fiber entangled body by a smoothing roll of 160° C. before impregnating the elastic polymer. After smoothing by a smoothing roll of 170° C., the leather-like sheet was embossed by an embossing roll of 170° C., to obtain a grain-finished artificial leather having a densified layer (grain surface) composed of a united composite of the microfine fibers and the elastic polymer. The existence density of bundles of microfine fibers was 2000/mm$^2$ in the surface layer within a depth of 0.2 mm from the surface and 1200/mm$^2$ in the lower layer within a depth of 0.2 mm or more from the surface. The ratio of existence densities (surface layer/lower layer) was 1.7. The hand, dense feeling and surface appearance were good. The surface contained fine pores having an average pore size of 20 μm in a density of 200/mm$^2$. The air permeability was as high as 8.0 cc/(cm$^2$·s) and the water vapor permeability was as high as 2600 g/(m$^2$·24 h).

Example 5

A water dispersion having a solid concentration of 10% was prepared by using a gray water-dispersible pigment and the (meth)acrylic acid derivative-acrylonitrile polymer capable of forming a crosslinked structure used in Example 3. The water dispersion was coated on the surface of the nubuck artificial leather obtained in Example 3 in a coating amount of 10 g/m$^2$ (solid basis) by using a 200-mesh gravure coater, dried and then solidified. Thereafter, by embossing using an embossing roll of 165° C., a gray semi grain-finished artificial leather was obtained. The obtained semi grain-finished artificial leather had a surface where napped fibers and skin layer were mixedly present, and a good semi grain-finished appearance, surface touch and hand. The fastness to wet friction was Grade 3-4. The surface abrasion loss was as low as 10 mg. Thus, the semi grain-finished artificial leather had properties suitable for interior, clothes and shoes application.

Example 6

The nubuck artificial leather obtained in Example 3 was smoothed by a smoothing roll of 165° C. and then coated with a water dispersion (solid concentration: 10%) of the non-crystallizing polycarbonate/polyether polyurethane containing a gray water-dispersible pigment in a coating amount of 20 g/m$^2$ (solid basis) using a 200-mesh gravure coater. The coating was dried and solidified. Thereafter, by embossing using an embossing roll of 165° C., a gray grain-finished artificial leather was obtained. The existence density of bundles of microfine fibers was 2000/mm$^2$ in the surface layer within a depth of 0.2 mm from the surface and 1200/mm$^2$ in the lower layer within a depth of 0.2 mm or more from the surface. The ratio of the existence densities (surface layer/lower layer) was 1.7. The hand, dense feeling and surface appearance were good. The surface contained fine pores having an average pore size of 20 μm in a density of 80/mm$^2$. The air permeability was as high as 3.0 cc/(cm$^2$·s) and the water vapor permeability was as high as 2000 g/(m$^2$·24 h).

Example 7

A suede-finished artificial leather was produced in the same manner as in Example 1 except for changing the elastic polymer to the following (meth)acrylic acid derivative-styrene polymer capable of forming a crosslinked structure.

(Meth)Acrylic Acid Derivative-Styrene Polymer

Glass transition temperature Tg of soft component: −15° C.

Glass transition temperature Tg of hard component: 104° C.

Logarithmic value of storage elastic modulus at 50° C.: 6.0 Pa

Logarithmic value of loss elastic modulus at 50° C.: 5.2 Pa

Soft component/crosslinkable component/hard component (by mass): 85/5/10

SP value of hard component: 18.0 to 20.0 $[J/cm^3]^{1/2}$

The obtained suede-finished leather-like sheet has a dense feeling resembling natural leathers and an elegant napping appearance. The elastic polymer was bonded to the inside and around outer surface of the bundles of microfine long fibers. The average cross-sectional area of single fiber and the average cross-sectional area of bundles of microfine fibers were the same as those of Example 1. The surface abrasion loss was 36 mg and the fastness to wet friction was Grade 4. Thus, the suede-finished artificial leather had properties suitable for interior, car seat and shoes application.

Example 8

A suede-finished artificial leather was produced in the same manner as in Example 1 except for changing the elastic polymer to a 60:40 mixture (by mass) of the (meth)acrylic acid derivative polymer used in Example 1 and a non-crystallizing polycarbonate/polyether polyurethane elastomer. The obtained suede-finished artificial leather had a relatively hard hand suitable for shoes and briefcase application, a dense feeling resembling natural leathers and an elegant napping appearance. The elastic polymer was bonded to the inside and around upper surface of the bundles of microfine long fibers. The average cross-sectional area of single fiber and the average cross-sectional area of bundles of microfine fibers were the same as those of Example 1. The surface abrasion loss was 35 mg and the fastness to wet friction was Grade 4. Thus, the suede-finished artificial leather has properties suitable for interior, car seat and shoes application.

Example 9

A suede-finished artificial leather containing the microfine-fiber entangled body, the (meth)acrylic acid derivative elastomer and the polyurethane elastomer in a ratio of 84:10:6 by mass was produced in the same manner as in Example 3 except for subjecting the entangled nonwoven fabric to areal shrinking by 40% at 70° C. and 90% RH, drying at 120° C., smoothing by a smoothing roll of 140° C. to regulate the apparent density to 0.60 g/cm$^3$, and then impregnating a water dispersion (solid concentration: 10%) of non-crystallizing polycarbonate/polyether polyurethane elastomer before the conversion to microfine fibers. The obtained suede-finished artificial leather had a relatively hard hand suitable for shoe or briefcase application, a dense feeling resembling natural leathers and an elegant napping appearance. The elastic polymer was bonded to the inside and around upper surface of the bundles of microfine long fibers. The average cross-sectional area of single fiber was the same as that of Example 3. The average cross-sectional area of bundles of microfine fibers was 140 μm$^2$ and the existence density of bundles of microfine fibers was 1400/mm$^2$ in average. The surface abrasion loss was 25 mg and the fastness to wet friction was Grade 3-4. Thus, the suede-finished artificial leather had sufficient properties.

Example 10

A suede-finished artificial leather was produce in the same manner as in Example 1 except for omitting the use of the elastic polymer. The thickness was 1.2 mm, the mass per unit area was 625 g/m$^2$, and the apparent density was 0.40 g/cm$^3$. The average cross-sectional area of single fiber was 7 μm$^2$, the average cross-sectional area of bundles of microfine fibers was 170 μm$^2$, and the existence density of bundles of microfine fibers was 1000/mm$^2$ in average. The Martindale abrasion loss was 50 mg, the interlaminar peeling strength was 13 kg/2.5 cm, and the tear strength per 100 g/m$^2$ was 1.2 kg. The obtained product was a suede-finished artificial leather with long naps having a good dense feeling and color development. The fastness to wet friction was Grade 4. Thus, the suede-finished artificial leather had properties suitable for wall materials and interior application.

INDUSTRIAL APPLICABILITY

According to the present invention, a leather-like sheet is produced by an environmentally-friend method. The leather-like sheet has an excellent flexibility and hand such as dense feeling each resembling natural leathers and an appearance with high quality. The leather-like sheet is excellent in the fastness and quality stability such as surface abrasion resistance and also in the practical performance. A grain-finished artificial leather, suede-finished artificial leather, or semi grain-finished artificial leather having the leather-like sheet as its substrate is suitable as the materials for leather-like products such as shoes, balls, furniture, vehicle seats, clothes, gloves, baseball gloves, briefcases, belts and bags.

What is claimed is:

1. A leather-like sheet which comprises a microfine-fiber entangled body made of bundles of microfine fibers and an elastic polymer impregnated into the microfine-fiber entangled body, which meets the following requirements:

(1) the bundles of microfine fibers comprises microfine monofibers having an average cross-sectional area of 0.1 to 30 μm$^2$ and an average cross-sectional area of the bundles of microfine fibers is 40 to 400 μm$^2$;

(2) the bundles of microfine fibers exist in a density of 600 to 4000/mm$^2$ on a cross section taken along a thickness direction of the microfine-fiber entangled body;

(3) the elastic polymer comprises 30 to 100% by mass of a polymer of ethylenically unsaturated monomer, and the polymer of ethylenically unsaturated monomer comprises 80 to 98% by mass of a soft component having a glass transition temperature (Tg) of lower than −5° C., 1 to 20% by mass of a crosslinkable component, 0 to 19% by mass of a hard component having a glass transition temperature (Tg) of higher than 50° C. and 0 to 19% by mass of another component; and (4) the polymer of ethylenically unsaturated monomer is bonded to microfine fibers in the bundles of microfine fibers.

2. The leather-like sheet according to claim 1, wherein the polymer of ethylenically unsaturated monomer is a polymer of (meth)acrylic acid derivative which comprises 80 to 98% by mass of acrylic acid derivative units, 1 to 20% by mass of crosslinkable units, 0 to 19% by mass of methacrylic acid derivative units and/or acrylonitrile derivative units, and 0 to 19% by mass of another ethylenically unsaturated monomer units.

3. The leather-like sheet according to claim 1, wherein a logarithmic value of storage elastic modulus at 50° C. of the polymer of ethylenically unsaturated monomer is 4.0 to 6.5 Pa, and a logarithmic value of loss elastic modulus at 50° C. of the polymer of ethylenically unsaturated monomer is 3.0 to 6.0 Pa.

4. The leather-like sheet according to claim 1, wherein a logarithmic value of storage elastic modulus at 150° C. of the polymer of ethylenically unsaturated monomer is 4.0 Pa or more, and a logarithmic value of loss elastic modulus at 150° C. of the polymer of ethylenically unsaturated monomer is 3.0 to 6.0 Pa.

5. The leather-like sheet according to claim 2, wherein the elastic polymer is a mixture of the polymer of (meth)acrylic acid derivative and a polyurethane resin in a ratio of 30:70 to 100:0 by mass.

6. The leather-like sheet according to claim 1, wherein the polymer of ethylenically unsaturated monomer is substantially not dyed.

7. The leather-like sheet according to claim 1, wherein the microfine-fiber entangled body comprises bundles of microfine long fibers.

8. The leather-like sheet according to claim 1, wherein a ratio of the microfine-fiber entangled body and the elastic polymer is 100:0 to 70:30 by mass.

9. The leather-like sheet according to claim 1, having a density gradient structure wherein an existence density of the bundles of microfine fibers is 1000 to 5000/mm$^2$ in a surface layer within a depth of 0.2 mm from the surface of the leather-like sheet, and a ratio of the existence density of the bundles of microfine fibers in the surface layer and an existence density of the bundles of microfine fibers in a lower layer within a depth of 0.2 mm or more from the surface of the leather-like sheet is 1.3 to 5.0, each existence density of the bundles of microfine fibers being defined as the number of the bundles of microfine fibers per 1 mm$^2$ on a cross section taken along a thickness direction of the fiber entangled body.

10. A suede-finished artificial leather comprising the leather-like sheet as defined in claim 1 which has a napped surface.

11. A semi grain-finished artificial leather comprising the leather-like sheet as defined in claim 1 wherein grain portions and naps are mixedly present on a surface thereof.

12. A grain-finished artificial leather comprising the leather-like sheet as defined in claim 1 which has a grain-finished surface.

13. The grain-finished artificial leather according to claim 12, wherein the grain-finished surface comprises a densified layer made of a united composite of the microfine fibers and the elastic polymer, the densified layer being formed within a depth of 0.2 mm from a surface of the leather-like sheet, and wherein the grain-finished surface contains fine pores having an average pore size of 50 μm or less in a density of $20/cm^2$ or more.

14. A method of producing a leather-like sheet which comprises:

(1) a step of producing a fiber web made of microfine fiber-forming fibers;

(2) a step of entangling the fiber web to obtain an entangled nonwoven fabric;

(3) a step of subjecting the entangled nonwoven fabric to areal shrinking by 35% or more;

(4) a step of converting the microfine fiber-forming fibers in the entangled nonwoven fabric after shrinking to microfine fibers, thereby producing a microfine-fiber entangled body comprising bundles of microfine fibers having an average cross-sectional area of 40 to 400 $\mu m^2$, the bundles of microfine fibers comprising microfine monofibers having an average cross-sectional area of 0.1 to 30 $\mu m^2$, and the bundles of microfine fibers existing in a density of 600 to $4000/mm^2$ on a cross section taken along a thickness direction of the microfine-fiber entangled body; and (5) a step of impregnating an elastic polymer into the microfine-fiber entangled body, the elastic polymer comprising 30 to 100% by mass of a polymer of ethylenically unsaturated monomer, and the polymer of ethylenically unsaturated monomer comprising 80 to 98% by mass of a soft component having a glass transition temperature (Tg) of lower than −5° C., 1 to 20% by mass of a crosslinkable component, 0 to 19% by mass of a hard component having a glass transition temperature (Tg) of higher than 50° C. and 0 to 19% by mass of another component.

15. The method according to claim 14, further comprising a step of dyeing the microfine-fiber entangled body before impregnating the elastic polymer.

16. The method according to claim 14, wherein at least one of components constituting the microfine fiber-forming fibers is a water-soluble, thermoplastic resin.

17. The method according to claim 14, wherein the microfine-fiber entangled body has Martindale surface abrasion loss of 100 mg or less when measured after 50,000 abrasion cycles and an interlaminar peeling strength of 8 kg/2.5 cm or more.

* * * * *

UNITED STATES PATENT AND TRADEMARK OFFICE

CERTIFICATE OF CORRECTION

PATENT NO. : 8,445,391 B2
APPLICATION NO. : 12/088565
DATED : May 21, 2013
INVENTOR(S) : Nakayama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1018 days.

Signed and Sealed this
Eighth Day of September, 2015

Michelle K. Lee

Michelle K. Lee
*Director of the United States Patent and Trademark Office*